US009123308B2

(12) United States Patent
Moriyama et al.

(10) Patent No.: US 9,123,308 B2
(45) Date of Patent: Sep. 1, 2015

(54) DISPLAY MEMORY, DRIVER CIRCUIT, DISPLAY, AND PORTABLE INFORMATION DEVICE

(75) Inventors: Katsutoshi Moriyama, Saga (JP); Tomoya Ayabe, Nagasaki (JP); Taishi Mizuta, Nagasaki (JP)

(73) Assignee: SONY CORPORATION, Tokyo (JP)

( * ) Notice: Subject to any disclaimer, the term of this patent is extended or adjusted under 35 U.S.C. 154(b) by 1658 days.

(21) Appl. No.: 11/470,823

(22) Filed: Sep. 7, 2006

(65) Prior Publication Data

US 2007/0024606 A1 Feb. 1, 2007

Related U.S. Application Data

(62) Division of application No. 10/432,937, filed as application No. PCT/JP02/10009 on Sep. 27, 2002, now Pat. No. 7,176,864.

(30) Foreign Application Priority Data

Sep. 28, 2001 (JP) ..... 2001-304369
Sep. 28, 2001 (JP) ..... 2001-304370
Sep. 28, 2001 (JP) ..... 2001-304371

(51) Int. Cl.
*G09G 3/36* (2006.01)
*G09G 3/20* (2006.01)
(Continued)

(52) U.S. Cl.
CPC ..... *G09G 3/3685* (2013.01); *G09G 3/20* (2013.01); *G09G 5/393* (2013.01); *G09G 5/395* (2013.01);
(Continued)

(58) Field of Classification Search
USPC ..... 345/87, 89, 98, 100
See application file for complete search history.

(56) References Cited

U.S. PATENT DOCUMENTS 4,903,239 A 2/1990 Akashi
5,298,816 A 3/1994 Kaplinsky
(Continued)

FOREIGN PATENT DOCUMENTS

EP 0 453 997 10/1991
EP 0 473 819 3/1992
(Continued)

OTHER PUBLICATIONS

Supplementary European Search Report dated Nov. 2, 2009.
(Continued)

*Primary Examiner* — William Boddie
*Assistant Examiner* — Leonid Shapiro
(74) *Attorney, Agent, or Firm* — Dentons US LLP

(57) ABSTRACT

A display memory able to reduce power consumption, able to generate graphics at a high speed, and not needing memory mapping, a driver circuit, a display using the driver circuit, and a portable information apparatus, wherein a CPU read circuit is connected to one bit line of a display memory 7, a display read circuit is connected to the other bit line, a write circuit is connected to both bit lines, the CPU read circuit and write circuit are assigned to the access from the CPU, the display read circuit is assigned to the display screen display, and further the access from the CPU and the reading to the display screen are assigned to different two level periods of a clock signal of the memory and independently controlled. Further, a drive power supply of the display memory is divided and a drive power supply voltage is supplied to the display memory for every memory cell or for every plurality of memory cells.

19 Claims, 16 Drawing Sheets

(51) Int. Cl.

| | |
|---|---|
| ***G09G 5/393*** | (2006.01) |
| ***G09G 5/395*** | (2006.01) |
| *G09G 5/00* | (2006.01) |

(52) U.S. Cl.

CPC ..... *G09G 3/2003* (2013.01); *G09G 3/3611* (2013.01); *G09G 5/001* (2013.01); *G09G 2310/027* (2013.01); *G09G 2310/0297* (2013.01); *G09G 2330/021* (2013.01); *G09G 2330/026* (2013.01); *G09G 2330/027* (2013.01); *G09G 2360/126* (2013.01)

(56) References Cited

U.S. PATENT DOCUMENTS

| | | | | |
|---|---|---|---|---|
| 5,663,745 | A | 9/1997 | Ishikawa et al. | |
| 5,815,136 | A | 9/1998 | Ikeda et al. | |
| 5,953,246 | A | 9/1999 | Takashima | |
| 6,205,049 | B1 | 3/2001 | Lien et al. | |
| 6,278,437 | B1 * | 8/2001 | Iga et al. | 345/598 |
| 6,348,910 | B1 * | 2/2002 | Yamamoto et al. | 345/102 |
| 2002/0075272 | A1 | 6/2002 | Tani et al. | |
| 2003/0030614 | A1 * | 2/2003 | Tajima et al. | 345/89 |
| 2003/0034948 | A1 * | 2/2003 | Imamura | 345/98 |

FOREIGN PATENT DOCUMENTS

| | | |
|---|---|---|
| EP | 1 056 261 | 11/2000 |
| GB | 2 090 494 | 7/1982 |
| JP | 54-107228 | 8/1979 |
| JP | 58-122693 | 7/1983 |
| JP | 60-85489 | 5/1985 |
| JP | 61-98390 | 5/1986 |
| JP | 1-178997 | 7/1989 |
| JP | 6-324643 | 11/1994 |
| JP | 6-342593 | 12/1994 |
| JP | 7-64514 | 3/1995 |
| JP | 7-129112 | 5/1995 |
| JP | 9-16117 | 1/1997 |
| JP | 11-085065 | 3/1999 |
| WO | 00/03381 | 1/2000 |
| WO | 01/29814 | 4/2001 |

OTHER PUBLICATIONS

M.E. Dean et al.; CPU Handshake to dual ported graphics memory; IBM Technical Disclosure Bulletin; vol. 27, No. 3; Aug. 1, 1984; pp. 1655-1657.

Lorne Trottier and Branko Matic; Transparent memory ends conflicts over CRT control; Electronics, vol. 52, No. 14; Jul. 5, 1979; pp. 136-139.

Decision to Refuse a European Patent Application dated Dec. 14, 2011.

EP Communication dated Jul. 26, 2011 in connection with counterpart EP Application No. 02 800 259.0.

* cited by examiner

7 MEMORY

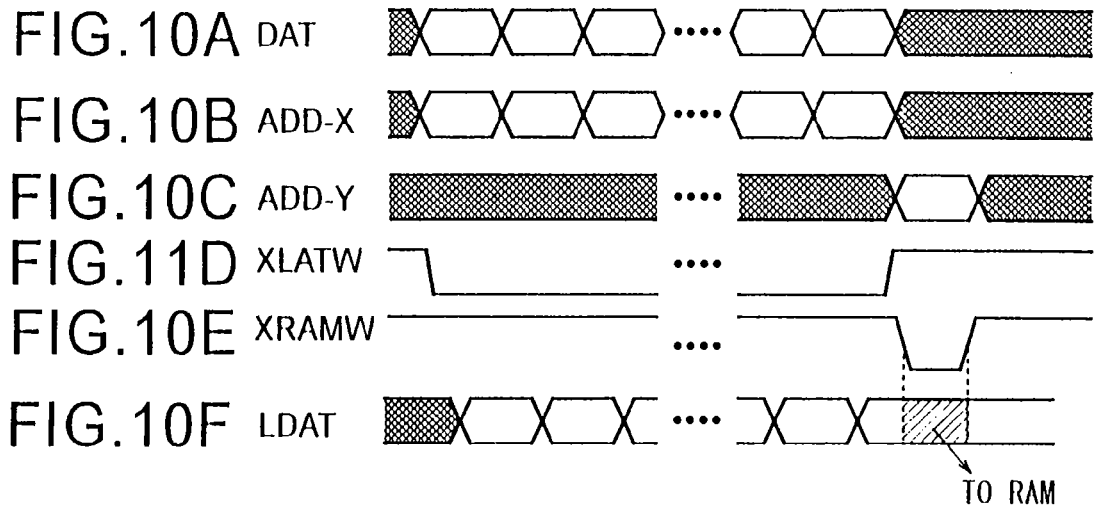
FIG.10A DAT
FIG.10B ADD-X
FIG.10C ADD-Y
FIG.11D XLATW
FIG.10E XRAMW
FIG.10F LDAT
TO RAM
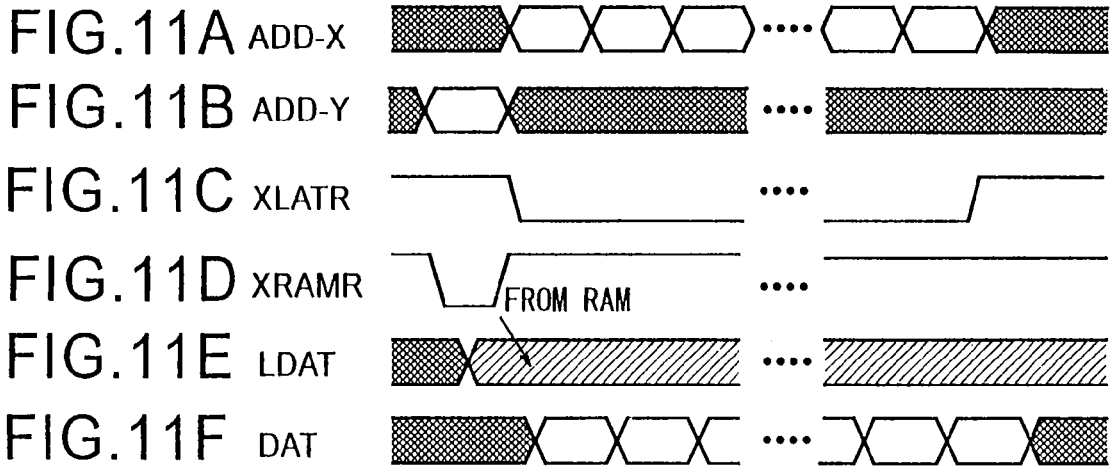
FIG.11A ADD-X
FIG.11B ADD-Y
FIG.11C XLATR
FIG.11D XRAMR
FROM RAM
FIG.11E LDAT
FIG.11F DAT FIG.14A LCWRQ
FIG.14B LNWRQ
FIG.14C WADR
FIG.14D CK
FIG.14E WF
FIG.14F WL
SET FLAG
WRITE START
RESET WRITE FLAG
WRITE END

DISPLAY MEMORY, DRIVER CIRCUIT, DISPLAY, AND PORTABLE INFORMATION DEVICE

RELATED APPLICATION DATA

This application is a divisional of U.S. patent application Ser. No. 10/432,937 filed Feb. 2, 2004 now U.S. Pat. No. 7,176,864, the entirety of which is incorporated herein by reference to the extent permitted by law. The present invention claims priority to Japanese patent application nos. 2001-394369, 2001-304370, and 2001-304371 all filed in the Japanese Patent Office on Sep. 28, 2001 and to PCT/JP02/10009 filed on Sep. 27, 2002, the entirety of which are incorporated by reference herein to the extent permitted by law.

BACKGROUND OF THE INVENTION

The present invention relates to a display memory for storing pixel data to be supplied to pixels of a display, a driver circuit having a display memory and driving pixels arrayed in a matrix of the display by signals corresponding to the image data, a display using the driver circuit, and a portable information device.

Liquid crystal displays are being widely used as display systems of mobile phones and PDAs (Personal Digital Assistants) and other portable information devices by making use of their light weight, thinness, low power consumption, and other features. Further, due to the spread of mobile phones and the Internet, the displays of portable information devices are being required to be further enlarged in size, offer color, and otherwise be improved in quality and are being strongly required to be ultra-low in power consumption for realizing long hours of usage. In liquid crystal drivers, therefore, it has become important to realize lower power consumption while handling larger screens and color.

In conventional liquid crystal drivers, the power consumption of the logic circuits inside the LSI has been lowered by a variety of methods, but if dealing with the enlargement of size of screens or colorization and other improvements in image quality, the number of drive devices increases, so the power consumption rises accordingly.

In order to realize lower power consumption, the method of building a display memory (also referred to as a "frame memory") into a liquid crystal driver has been employed. This eliminates the need for a controller memory for transfer of display data, slashes the number of parts, and realizes a reduction of the power consumption.

Further, a new drive system may be employed to reduce the power consumption.

Concerning this subject, for example, Japanese Unexamined Patent Publication (Kokai) No. 7-64514 discloses a liquid crystal driver having a built-in general purpose memory realizing high speed and lower power and a liquid crystal display using that driver.

Further, Japanese Unexamined Patent Publication (Kokai) No. 2000-293144 discloses a liquid crystal display device using a liquid crystal driver with a built-in memory generating graphics with a low power consumption and at a high speed and able to reduce the load of the CPU.

Further, Japanese Unexamined Patent Publication (Kokai) No. 7-281634 discloses a liquid crystal display using a liquid crystal driver with a built-in memory achieving lower power consumption and realizing high speed graphic drawing access.

Further, Japanese Unexamined Patent Publication (Kokai) No. 7-230265 realizes a liquid crystal drive device improving the means of supply of power and having a built-in memory with a low power consumption and a large capacity.

Further, Japanese Unexamined Patent Publication (Kokai) No. 7-175445 discloses a technique achieving lower power consumption and higher speed graphic drawing without lowering the operating efficiency of the system by building into the liquid crystal driver a display memory accessible by a general purpose memory interface.

In the layout of an LSI of a liquid crystal driver having a built-in conventional display memory, however, the interface has terminals at one side of the general purpose memory cells, so general purpose interface signal interconnects must be detoured around them. Power is taken for the amount of those interconnects.

Further, a conventional display memory uses data buses, address buses, and control signal buses for display and graphics drawing and requires bus arbitration. Due to this, if the number of accesses for display is large, the time for the drawing is reduced.

Further, in the conventional system, the memory is accessed from the CPU for every group of pixels. Therefore, for example, when desiring to store one screen's worth of data from the CPU into the memory, (one screens's worth of number of pixels)/(number of pixels in group of pixels) of write operations to the memory are required, so the number of times of operation of the memory was large. The operating power consumption of the memory is proportional to the number of times of read/write operations, therefore consequently an increase of the power consumption is induced.

Further, when transferring display data from the memory to the liquid crystal panel, one horizontal line on the display screen's worth of the display data was simultaneously output, but the data was read from the memory for this purpose not in amounts of one horizontal line at one time, but in amounts of an output data line of the liquid crystal driver.

For example, when desiring to display one screen's worth of data stored in a memory on an LCD display screen, (one screen's worth of number of pixels)/(group of pixels) of read operations of the memory become necessary, so there is the disadvantage that power of the amount of the number of times of access is consumed.

Further, in the conventional system, the operation has to be performed at the high frequency of the memory. No margin can be given to the access time of the CPU. Therefore, there is a disadvantage that this is not suited display of a moving picture requiring quick switching of the screen.

Further, when using a conventional memory, the images of the memory array and the pixel array of the liquid crystal are not the same, so it is necessary to calculate where a pixel is in the memory at the time of drawing.

Further, a conventional display memory rewrites all data to be written at one time when writing data. Accordingly, when there is a data which is not desired to be changed in the data to be written at one time, a so-called read-modify-write system which reads out the data in advance before rewriting the data, modifies the bits to be rewritten while masking the data not desired to be rewritten, and then writes the data into the memory is employed. For this reason, there were the disadvantages that the number of operation was large and power was consumed.

Further, conventionally, when outputting image data stored in a display memory to a digital/analog converter (DAC), since RGB data corresponding to the three primary colors of the color cannot be output in a time division manner, the outputs of the display memory were directly connected to DACs in one-to-one correspondence. In this way, conventionally, since a DAC was necessary for every RGB data, the number of DACs was large and an increase of the power consumption was induced.

In order to reduce the power consumption of the DACs, the settling time must be adjusted. Since the operating speeds of the DACs and the display memory are different, they must be separately controlled. Depending on the characteristics of the DACs, the phases of the input signals must be adjusted. Conventionally, however, when outputting the data of the display memory to the DACs, the timing for outputting the RGB data is fixed. The phase of the data cannot be freely changed to match with the characteristics of the DACs, so this necessity could not be coped with.

Further, in order to lower the power consumption of a liquid crystal display, there is the method of lowering the power supply voltage. When the operating power supply voltage becomes smaller than 3.0V, however, malfunctions occur. Further, for a method of supplying power considering power conservation, there is a partial display mode used in a standby screen of mobile phones, but in this partial display mode, although nothing is displayed on the screen, leakage current of the memory cells still flows, so there is the disadvantage of consumption of power.

SUMMARY OF THE INVENTION

An object of the present invention is to provide a display memory able to reduce the power consumption, able to draw graphics at a high speed, and free from the need for memory mapping, a driver circuit provided with this display memory, a display using that driver circuit, and a portable information device.

To attain the above object, a first aspect of the present invention is a display memory for storing pixel data to be supplied to pixels of a display, comprising at least one pair of bit lines; at least one column of memory cells each having a first storage node and a second storage node able to hold states of a complementary first level and second level; a first read circuit for reading the stored data of the first storage node output to one bit line of the pair of bit lines; and a second read circuit for reading the stored data of the second storage node output to the other bit line of the pair of bit lines.

Further, the second read circuit inverts and outputs the level of the stored data of the second storage node output to the other bit line. Provision is further made of a write circuit for outputting the data of the first level and second level to the first and second storage nodes of the memory cells to each the pair of bit lines and writing the data into the memory cells.

Further, the display memory comprises a controlling means for controlling the operation of the display memory, a write port including at least one the write circuit, a first read port including at least one the first read circuit, and a second read port including at least one the second read circuit, wherein the first read port supplies the data stored in the memory cell to the display, the second read port reads the data from the memory cell and outputs the same to the controlling means, and the write port writes the data from the controlling means into the memory cell.

Further, in a first level period of a clock signal of the display memory, the first read port performs a first access for outputting the data read via the first read circuit to the display, and in a second level period of the clock signal of the display memory, the second read port and the write port perform a second access for outputting the data read via the second read circuit to the controlling means and inputting the write data to be written into the memory cell from the controlling means.

Further, the display memory comprises a bit selecting means for selecting the memory cell into which the data is to be written and a write control signal for controlling the writing of the data into the memory cell into which the data is to be written, and the write circuit is controlled by the bit selecting means and the write control signal and outputs the data of the first level and second level at the first and second storage nodes of the memory cell selected by the bit selecting means to each of the pair of bit lines of the memory cell to be written.

Further, the display memory has a drive use power supply voltage source for the display memory and a switching device for selectively connecting a power supply voltage supply end of at least one memory cell and the drive use power supply voltage source.

Further, signal terminals for the first access are arrayed at one side part of the display memory, signal terminals for the second access are arrayed in the other side part different from that one side part, and the first access use first interface and the second access use second interface are connected to the first access use signal terminals and the second access use signal terminals of the display memory while sandwiching the display memory therebetween.

Preferably, the first interface has a first line latch for storing one line's worth of image data in a horizontal direction of pixels arrayed in the matrix, and, via the first line latch, the write port outputs the one line's worth of data to the selected bit line and the second read port outputs the one line's worth of data from the display memory to the controlling means.

Preferably, the second interface has a second line latch for storing one line's worth of image data in the horizontal direction of pixels arrayed in a matrix, and the first read port outputs the one line's worth of data from the display memory to the display via the second line latch.

Further, in the display, a plurality of pixel cells are arrayed in a matrix, in the display memory, a plurality of memory cells are arrayed in a matrix corresponding to the matrix array of the plurality of pixel cells, in each memory cell of the display memory, the pixel data for driving the corresponding pixel cell of the matrix of the display is stored by the write port, and the first read port latches the image data in the second line latch in units of lines and supplies the same to the pixels of the corresponding line of the display.

A second aspect of the present invention is a driver circuit for driving pixels arrayed in a matrix of a display by signals corresponding to image data stored in a display memory, wherein the display memory comprises at least one pair of bit lines; at least one column of memory cells each having a first storage node and a second storage node able to hold states of a complementary first level and second level; a first read circuit for reading the stored data of the first storage node output to one bit line of the pair of bit lines; and a second read circuit for reading the stored data of the second storage node output to the other bit line of the pair of bit lines.

Further, in the driver circuit, the first interface has a first line latch for storing one line's worth of image data in a horizontal direction of the pixels arrayed in a matrix, and, via the first line latch, the write port outputs the one line's worth of data to the selected bit line and the second read port outputs the one line's worth of data from the display memory to the controlling means.

Further, the first line latch stores write control data for designating the pixel data to be written into the display memory for every pixel among the pixel data latched by the first line latch, and the write port writes the pixel data latched at the first line latch designated by the write control data into the display memory.

A third aspect of the present invention is a driver circuit for driving pixels arrayed in a matrix of a display by signals corresponding to pixel data supplied from a controlling means and stored in the display memory, comprising a line latch for storing one line's worth of pixel data in a horizontal direction of the pixels arrayed in a matrix and a driving means for writing the data supplied from the controlling means into the display memory via the line latch in units of the one line's worth of the image data, reading the image data from the display memory, and outputting the same to the controlling means.

Concretely, the driving means stores the image data in the line latch up to the amount of one line, then writes the same into the display memory at one time. Further, the driving means outputs one line's worth of the image data in the horizontal direction of the pixels arrayed in a matrix at one time from the display memory to the line latch.

Further, the driving means stores each pixel data in one line's worth of pixel data of the pixels arrayed in a matrix held in the line latch in the display memory as pixel data for driving a corresponding pixel in pixels of a corresponding line among the pixels arrayed in a matrix.

Further, the line latch stores for every pixel write control data for designating the pixel data to be written into the display memory in the pixel data held in the line latch, and the driving means writes the pixel data held in the line latch designated by the write control data into the display memory.

A fourth aspect of the present invention is a driver circuit for driving pixels arrayed in a matrix of a display by signals corresponding to pixel data supplied from a controlling means and stored in the display memory, comprising a line latch for storing one line's worth of pixel data in a horizontal direction of the pixels arrayed in a matrix and an outputting means for reading the image data from the display memory via the line latch in units of the one line's worth of the image data and outputting the same to the corresponding pixels of the display.

Preferably, the outputting means performs a first access for outputting the image data stored in the display memory to the pixels in a first level period of a clock signal of the display memory, and the controlling means performs a second access for reading the image data stored in the display memory and writing the data to be written into the display memory in a second level period of the clock signal of the display memory.

Further, provision is further made of a selection circuit for sequentially selecting R, G, B data included in the image data held in the line latch and converting the image data to time divided signals and digital/analog converting means for converting digital signals to analog signals, the selection circuit outputs the time divided signals obtained by time division of the R, G, B data included in the image data to the digital/analog converting means, and the digital/analog converting means convert the time divided signals to the analog signals and supply the same to the display.

Further, the selection circuit selects the R, G, B data included in the pixel data held in the line latch asynchronously to the clock signal of the display memory and converts them to time divided signals.

A display according to a fifth aspect of the present invention comprises a display screen wherein pixels are arrayed in a matrix; a scanning circuit for scanning the pixel matrix by each row and supplying voltage to a selected row; a driver circuit for outputting signals corresponding to image data to the pixels; and a display memory for storing the image data, wherein the display memory has at least one pair of bit lines, at least one column of memory cells each having a first storage node and a second storage node able to hold states of a complementary first level and second level, a first read circuit for reading the stored data of the first storage node output to one bit line of the pair of bit lines, and a second read circuit for reading the stored data of the second storage node output to the other bit line of the pair of bit lines.

A display according to a sixth aspect of the present invention comprises a display screen wherein pixels are arrayed in a matrix; a scanning circuit for scanning the pixel matrix by each one row and supplying a voltage to a selected row; a driver circuit for outputting signals corresponding to image data to the pixels; and a display memory for storing the image data, wherein the driver circuit has a line latch for storing one line's worth of image data in a horizontal direction of the pixels arrayed in a matrix and a driving means for writing the data supplied from the controlling means into the display memory or reading the image data from the display memory via the line latch in units of the one line's worth of the image data and outputting the same to the controlling means.

A display according to a seventh aspect of the present invention comprises a display screen wherein pixels are arrayed in a matrix; a scanning circuit for scanning the pixel matrix by each row and supplying a voltage to a selected row; a driver circuit for outputting signals corresponding to the image data supplied from the controlling means to the pixels; and a display memory for storing the image data, wherein the driver circuit has a line latch for storing one line's worth of image data in a horizontal direction of pixels arrayed in the matrix state and an outputting means for reading the image data from the display memory via the line latch in units of the one line's worth of image data and supplying the same to corresponding pixels of the display.

A portable information device according to a seventh aspect of the present invention comprises a display wherein a plurality of pixel cells are arrayed in a matrix and a display memory for storing pixel data to be supplied to pixel cells of the display, wherein the display memory has a controlling means for controlling the operation of the display memory, a plurality of memory cells, each having a first storage node and a second storage node able to hold states of a complementary first level and second level, arrayed in a matrix corresponding to the matrix array of the plurality of pixel cells, a first read port for reading the stored data of the first storage node of each memory cell, a second read port for reading the stored data of the second storage node of each memory cell, a write port for writing pixel data for driving corresponding pixel cells of the matrix of the display into the memory cells, a first line latch for storing one line's worth of pixel data in the horizontal direction of the pixel cells arrayed in a matrix, and a second line latch for storing one line's worth of image data in the horizontal direction of the pixel cells arrayed in a matrix; the write port outputs the one line's worth of data to a plurality of the memory cells via the first line latch; the first read port latches the image data in the second line latch in units of lines and outputs the same to corresponding pixel cells of the display; and the second read port outputs the one line's worth of data to the controlling means via the first line latch.

BRIEF DESCRIPTION OF THE DRAWINGS

FIGS. 10A to 10F are timing charts of an operation for writing data in units of lines of the driver circuit according to the fifth embodiment.

FIGS. 11A to 11F are timing charts of an operation for reading data in units of lines of the driver circuit according to the fifth embodiment.

BEST MODE FOR WORKING THE INVENTION

Below, embodiments of a display memory, a driver circuit, and a display using the driver circuit according to the present invention will be explained with reference to the attached drawings.

First Embodiment

Figure 1:
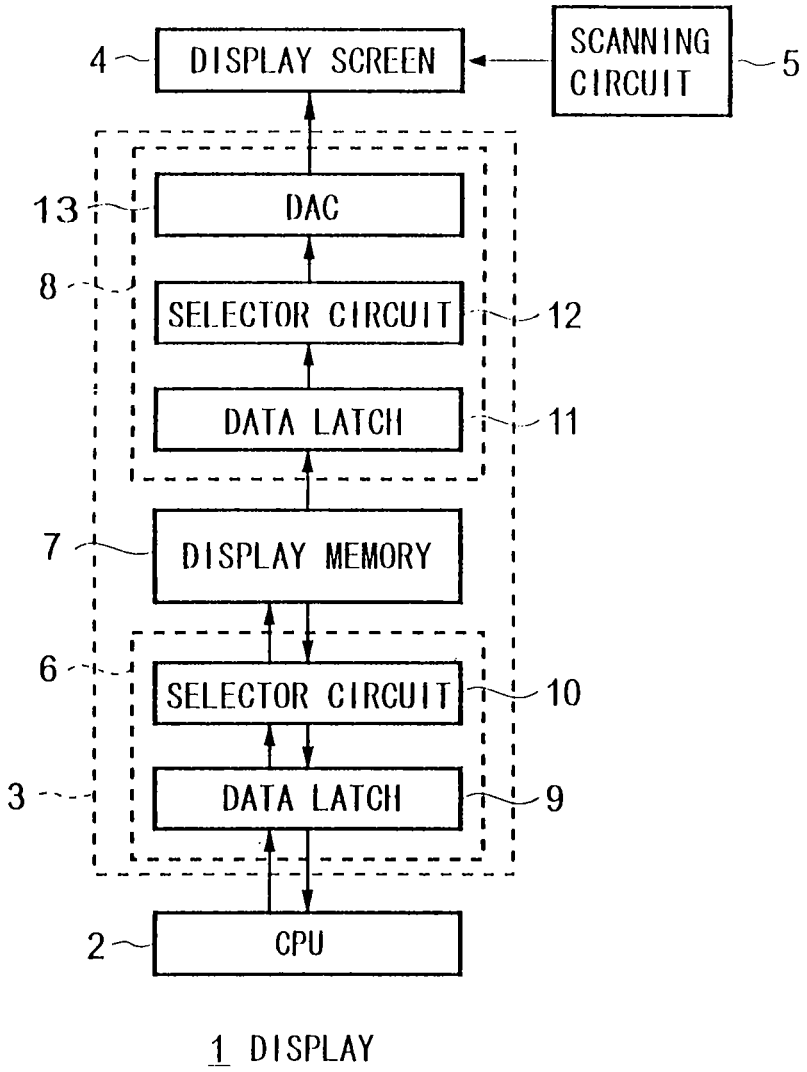
FIG. 1 is a view of the overall configuration of a display according to the present invention.

FIG. 1 is an overall view of the configuration of a first embodiment of a display 1 according to the present invention. Here, the explanation will be given by taking as an example a liquid crystal driver and a liquid crystal display using the liquid crystal driver circuit.

In the liquid crystal display 1 shown in FIG. 1, a processor (CPU) 2 for controlling the operation of the entire device, a liquid crystal driver 3, a display screen 4 (liquid crystal panel 4 in the case of a liquid crystal display) for displaying an image, and a scanning circuit 5 for selecting a row of pixels, to which addresses are given in a horizontal direction of the liquid crystal panel 4, and supplying voltage to pixels to turn them on are included.

The liquid crystal driver 3 has a display memory 7, a CPU side interface (CPU I/F) 6 for receiving the data for every pixel from the CPU 2 and writing the same into the display memory 7 or reading the pixel data stored in the display memory 7, and a panel side interface (LCD I/F) 8 for receiving pixel data including red (R), green (G), and blue (B) colors output by the display memory 7 and outputting the same to the liquid crystal panel 4 to display the same.

The CPU side interface (CPU I/F) 6 has a data latch 9 for storing the pixel data from the CPU 2 and a selector circuit 10.

The panel side interface (LCI I/F) 8 includes a data latch 11 for buffering the output of the memory, a selector circuit 12, and a digital/analog converter (DAC) 13 for converting the image data to be displayed from digital signals to analog signals and outputting the same to the pixels of the liquid crystal panel 4.

In order to display an image on the liquid crystal panel 4, the data for every pixel is transferred from the CPU 2 and stored up to the amount of one line in the horizontal direction of the liquid crystal panel 4 by the data latch 9 of the CPU I/F 6, then the one line's worth of data are simultaneously transferred to the display memory 7. From the display memory 7, one line's worth of pixel data in the horizontal direction of the liquid crystal panel 4 are simultaneously output and latched by the data latch 11 of the LCD I/F 8, then voltages in accordance with the pixel data are simultaneously supplied to the liquid crystal panel 4. By this, the pixel data is displayed on the screen.

In the present embodiment, the display memory 7 is configured by for example a single port SRAM.

Figure 2:
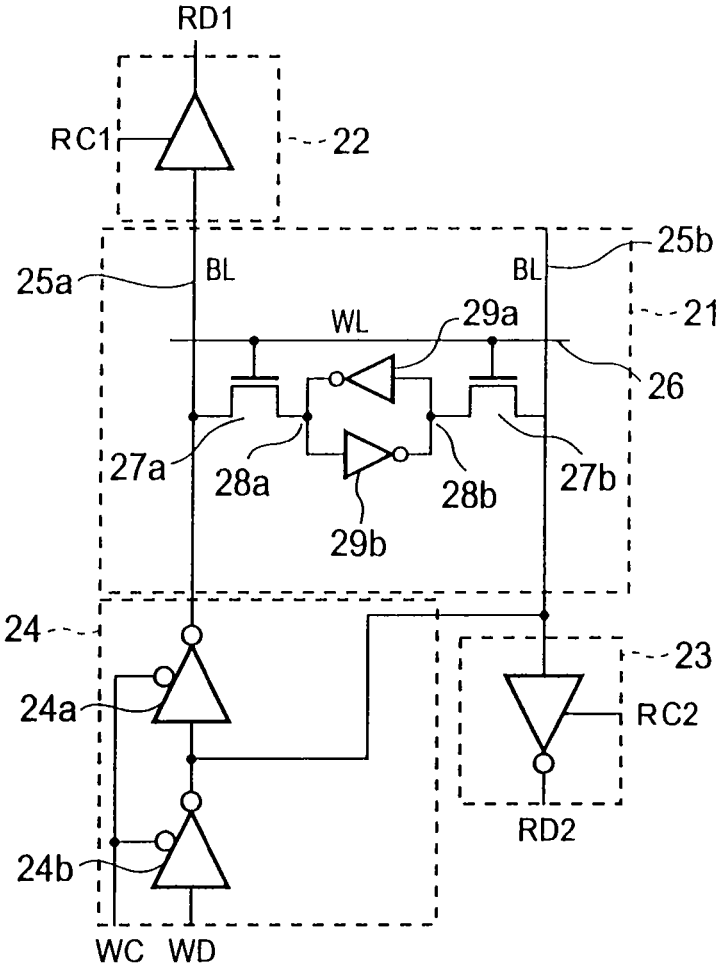
FIG. 2 is a circuit diagram of a concrete example of the configuration of a memory cell of a display memory according to a first embodiment.

FIG. 2 is a circuit diagram of a concrete example of the configuration of a memory cell of a display memory according to the present embodiment.

As shown in FIG. 2, the display memory 7 has a memory cell 21, a sense amplifier 22 as a first read circuit, a sense amplifier 23 as a second read circuit, a write circuit 24, a pair of bit lines (BL) 25*a* and 25*b*, and a word line (WL) 26.

In FIG. 2, the memory cell 21 of the display memory 7 has two inverters 29*a* and 29*b* having inputs and outputs connected to each other and NMOS transistors 27*a* and 27*b* as access transistors. A first storage node 28*a* is configured by a connection point of the output of the inverter 29*a* and the input of the inverter 29*b*, while a second storage node 28*b* is configured by a connection point of the input of the inverter 29*a* and the output of the inverter 29*b*.

The bit line 25*a* is connected via the NMOS transistor 27*a* to the first storage node 28*a*, while the bit line 25*b* is connected via the NMOS transistor 27*b* to the second storage node 28*b*. Gates of the NMOS transistors 27*a* and 27*b* of the memory cell 21 are connected to a common word line 26. When outputting data to the liquid crystal panel 4, the image data is read from the memory 7 by using the sense amplifier 22. The sense amplifier 23 is used when the CPU 2 reads the data from the memory 7. The CPU 2 writes the data into the memory 7 by using the write circuit 24.

RC1 and RC2 indicate control signals (sense amplifier control) of the sense amplifiers 22 and 23, while RD1 and RD2 indicate output data (read data) of the sense amplifiers 22 and 23. WC and WD indicate a control signal (write control) of the write circuit 24 and write data to the memory cell 21. The write circuit 24 has first drivers 24*a* and 24*b* connected in series and operating upon receipt of the low level and active control signal WC.

The display memory 7 of the present embodiment is for example a custom ARAM built into the liquid crystal driver 3. As shown in FIG. 2, as the components of the memory cell 21, the read sense amplifier 22 at the time of the display and the sense amplifier 23 for the CPU 2 to read the data from the memory cell are connected to both bit lines 25*a* and 25*b*. The sense amplifiers 22 and 23 can independently control the read operation. The sense amplifier 23 and the write circuit 24 can simultaneously operate. That is, it is possible to read data while writing data.

Next, the operation of the display memory 7 will be explained.

The pair of CMOS inverters 29*a* and 29*b*, for example, are supplied with a drive use power supply voltage of $V_{DD}$=3.3V. The pair of CMOS inverters 29*a* and 29*b* form a bi-stable flip-flop circuit. Among the bi-stable states, for example, the state where the node 28*a* is at a high level and the node 28*b* is at a low level is defined as meaning data "1" is stored, while conversely the state where the node 28*a* is at a low level and the node 28*b* is at a high level is defined as meaning that data "0" is stored.

When reading the data stored in the memory cell 21, first the scanning circuit 5 scans the memory cell matrix, a word line designated by a not illustrated row address decoder, for example, the word line 26 is selected, a voltage is supplied, and the NMOS transistors 27*a* and 27*b* become conductive in state.

When reading the data for every bit, a not illustrated column address decoder is used to designate a memory cell to be further read from, for example, the memory cell 21. At this time, the read control signal RC1 or RC2 becomes the high level, and the sense amplifier 22 or the sense amplifier 23 is turned on.

When reading data for every line or for every plurality of memory cells, a not illustrated means is used for example to designate a memory cell line including the memory cell 21 and to be read from or a plurality of memory cells.

Since the NMOS transistors 27*a* and 27*b* have become conductive in state, the states of the nodes 28*a* and 28*b* are transmitted to the sense amplifiers 22 and 23 connected to the bit lines 25*a* and 25*b*.

When outputting the data stored in the memory to the liquid crystal panel, the read control signal RC1 becomes the high level, the sense amplifier 22 turns on, and the present state of the memory cell 21, that is, "1" or "0", stored at the node 28*a* is extracted from the sense amplifier 22.

When reading the data stored in the memory from the CPU 2, the read control signal RC2 becomes the high level, the sense amplifier 23 turns on, and the value "0" or "1" which is a complementary to the node 28*a* stored at the node 28*b* is inverted at the sense amplifier 23 and data having the same value as that at the node 28*a* is extracted.

When writing the data from the CPU 2 into the memory cell 21, a memory cell or a plurality of memory cells are selected as described above, a word voltage is supplied, and the NMOS transistors 27*a* and 27*b* are made conductive in state. The write control signal WC of the selected memory cell becomes the low level, and the write circuit 24 turns on.

As shown in FIG. 2, the write circuit 24 has a first write driver 24*a* and a second write driver 24*b*, the write data WD input to the write circuit 24 is first inverted at the second write driver 24*b* and stored in the storage node 28*b* via the now on NMOS transistor 27*b*.

The inverted output of the second write driver 24*b* is input to the first write driver 24*a* and further inverted and stored in the storage node 28*a* via the now on NMOS transistor 27*a*.

For example, when the value of the write data WD is "1", it becomes "0" by the output of the second write driver 24*b* and is stored at the storage node 28*b*. The output "0" of the second write driver 24*b* is input to the first write driver 24*a*, then "1" is output and stored at the storage node 28*a*.

When the value of the write data WD is "0", similarly, "0" is stored at the storage node 28*a*, and "1" is stored at the storage node 28*b*.

Figure 3:
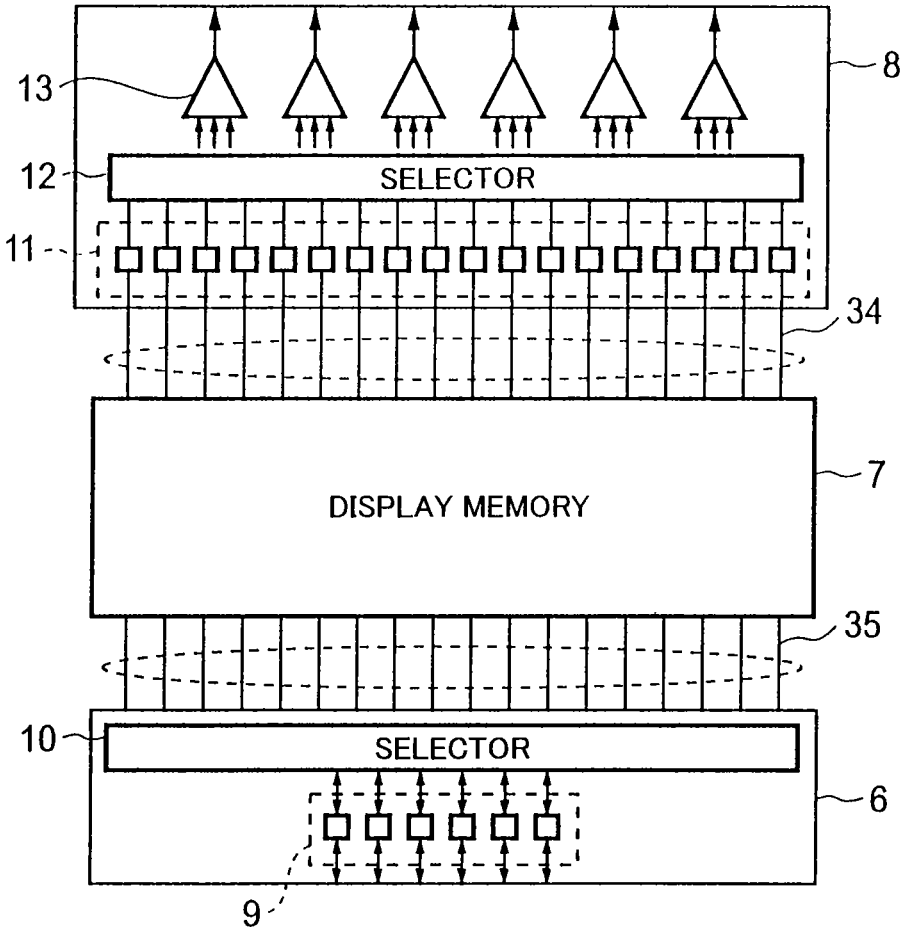
FIG. 3 is a view of the configuration of principal parts of a driver circuit according to the first embodiment.

FIG. 3 shows principal parts of the liquid crystal driver 3 having the above built-in display memory 7.

In FIG. 3, the same reference numerals are used for the same components as those of FIG. 1.

In FIG. 3, an interface circuit (CPU I/F) 6 on the CPU side includes a data latch 9, selector 10, etc. Reference numeral 7 indicates the display memory of the present embodiment, while 8 indicates the interface circuit for the liquid crystal panel display. The display use interface 8 includes circuits such as a data latch 11, a selector 12, and a DAC 13. Reference numerals 34 and 35 are a data bus for transferring the image data output by the memory 7 to the liquid crystal panel and a data bus for the CPU 2 to transfer the data to the memory 7.

The liquid crystal driver 3 shown in FIG. 3 operates as follows.

When writing the pixel data into the display memory 7, the CPU 2 sends the image data to be displayed to the display memory 7 for every pixel. The pixel data sent for every pixel is first stored in the data latch 9. The data stored in the data latch 9 up to a predetermined number of bits is output to the selector 10, selected there, and written into the display memory 7 through the data bus 35.

Alternatively, when the CPU 2 reads the pixel data stored in the display memory 7, the pixel data stored in the display memory 7 passes through the data bus 35 in units of a predetermined number of bits, and is held at the data latch 9 via the selector 10, then the data held at that data latch 9 is read to the CPU 2 for every pixel.

When reading the pixel data stored in the display memory 7 and displaying it on the liquid crystal panel, the pixel data stored in the display memory 7 passes through the data bus 34 in units of a predetermined number of bits and is held in the data latch 11. Then, the data held in the data latch 11 is output to the selector 12, and R, G, B portions of each pixel data are sequentially selected by the selector 12 by a predetermined method, output to the digital/analog converters (DACs) 13, and further output to the pixels of the liquid crystal panel.

In the present embodiment, the data bus 34 holds the number of bits of data required for one line in the horizontal direction of the liquid crystal panel. One line's worth of data can be calculated by one line's worth of the number of pixels× colors (number of bits). Concretely, where one line's worth of the number of pixels is 176 pixels and the colors are comprised of 18 bits (6 bits for each of R, G, B), it becomes an output data bus for 3168 bits. The number of bits of the data bus 35 is one line's worth of the number of bits of data in the same way as the data bus 34. When the number of pixels is 176 and the colors are comprised of 18 bits, the result is 3168 bits.

As shown in FIG. 3 and as described above, the display memory 7 has two read ports and one write port, assigns one read port and one write port for the access from the CPU 2, assigns the other read port for the liquid crystal panel 4, and assigns the pixel data to the display. The read and write access from the CPU 2 to the display memory can be simultaneously carried out since the read access from the display memory to the liquid crystal panel is independently controlled.

Further, the read and write access with respect to the display memory 7 of the CPU 2 and the read access from the display memory 7 to the liquid crystal panel 4 are assigned to the high level period and the low level period of the clock signal for controlling the operation of the display memory 7. The access from the CPU 2 and the read operation to the liquid crystal panel 4 do not interfere with each other, but are carried out in parallel.

FIGS. 4A to 4F are timing charts of the above operation.

Figures 4A, 4B, 4C, 4D, 4E, 4F:
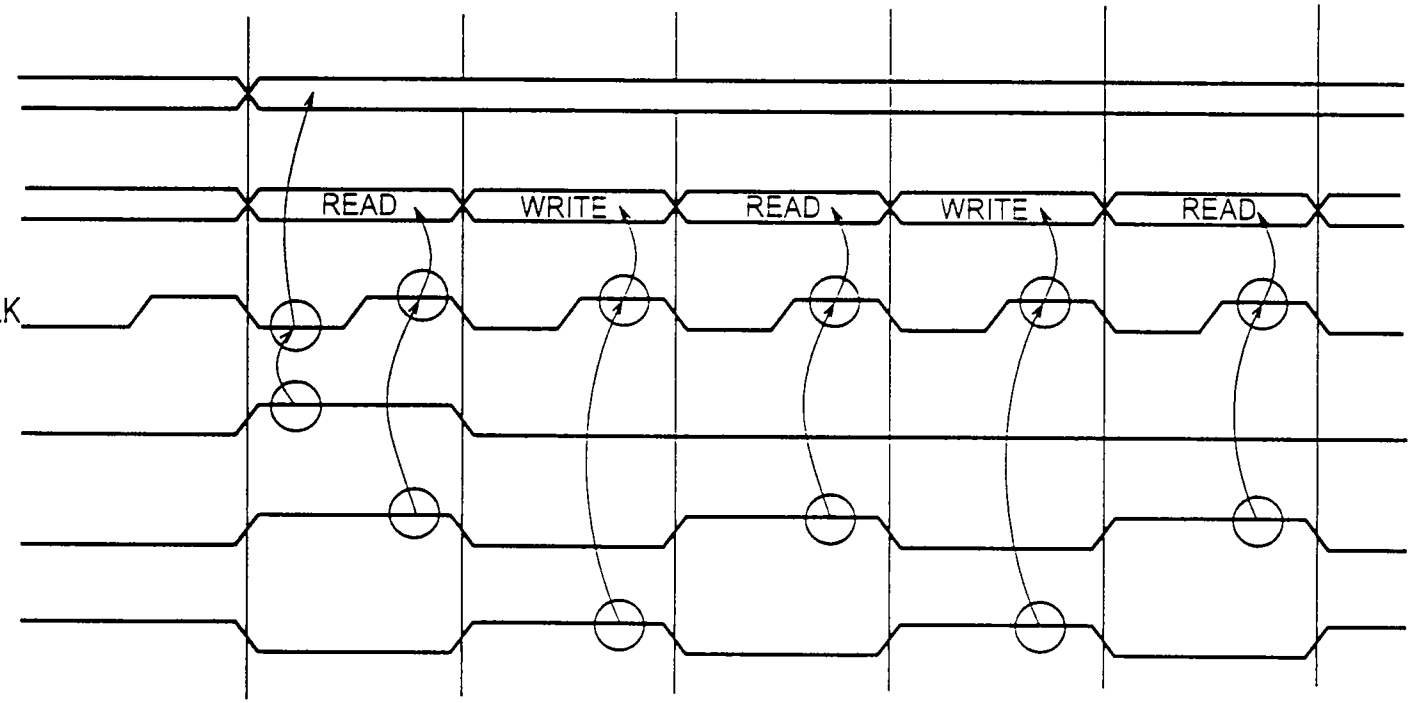
FIGS. 4A to 4F are timing charts of the operation of the display memory according to the first embodiment of the present invention.

FIG. 4A shows an address signal DRA of the read access when displaying an image. The address signal DRA is generated once for every display of a row. FIG. 4B shows an address signal CAA for the CPU 2 to access the display memory 7.

FIG. 4C shows a clock signal MCLK of the display memory 7. A high level period of the clock signal MCLK is the period for the CPU 2 to access the display memory 7. In this period, the CPU 2 reads pixel data from the display memory 7, or the CPU 2 writes image data into the display memory 7.

A low level period of the clock signal MCLK is used for the read period for the display. In this period, the image data stored in the display memory 7 is read and output to the pixels of the liquid crystal panel.

FIG. 4D shows a signal DR showing the read period for display. The read operation from the display memory is carried out in the period where the clock signal MCLK of the display memory 7 is at the low level.

FIG. 4E shows a signal CR indicating the period for the CPU 2 to read data from the display memory 7. The CPU 2 reads data from the display memory in the period where the clock signal MCLK of the display memory 7 is at the high level.

FIG. 4F shows a signal CW indicating the period for the CPU 2 to write data into the display memory 7. The CPU 2 writes data into the display memory in the period where the clock signal MCLK of the display memory 7 is at the high level.

According to the present embodiment, in a custom display memory built into a liquid crystal driver, each memory cell is equipped with two read sense amplifiers for the CPU and display on the two ends of the bit line and is provided with a write driver for the CPU, whereby it becomes possible to independently control the access for display and the read access from the CPU. By this, two systems of read ports and one system of write ports can be equipped. Therefore, if assigning them to the CPU and the liquid crystal panel display and further assigning the access of the CPU and the access for display to the high level period and the low level period of the system clock, the access from the CPU and the operation of reading for display can be simultaneously carried out in parallel and will not overlap. Namely, the operation for display and drawing and the reading of the data can be independently carried out. By this, even if the number of times of access for display increases, the time for the drawing and reading will not be reduced and the CPU will not be made to wait for display.

Further, in the display memory of the present embodiment, terminals are equipped at the facing sides of the display memory, and two interfaces are arranged sandwiching the display memory therebetween. One of them is used as the interface for the CPU side, and the other is used as the interface for the liquid crystal panel side. The two can be directly connected to the display memory. By this, there is no detouring of the signal lines, the amount of the interconnects can be reduced in comparison with the conventional general purpose interface, and the power consumption can be reduced by the amount of the interconnects.

Further, in comparison with the case of using a usual dual port SRAM, the single port SRAM of the present embodiment can greatly reduce the cell size.

Second Embodiment

In the second embodiment, an example where the power consumption is further reduced by dividing the power supply of the memory and independently providing power to different image data regions of the memory will be explained.

The display memory in the second embodiment has the configuration of the display memory of the first embodiment. Further, in the second embodiment, the display memory is divided into a plurality of regions, and ON/OFF state of the power is controlled for every separated region or operation mode.

Figure 5:
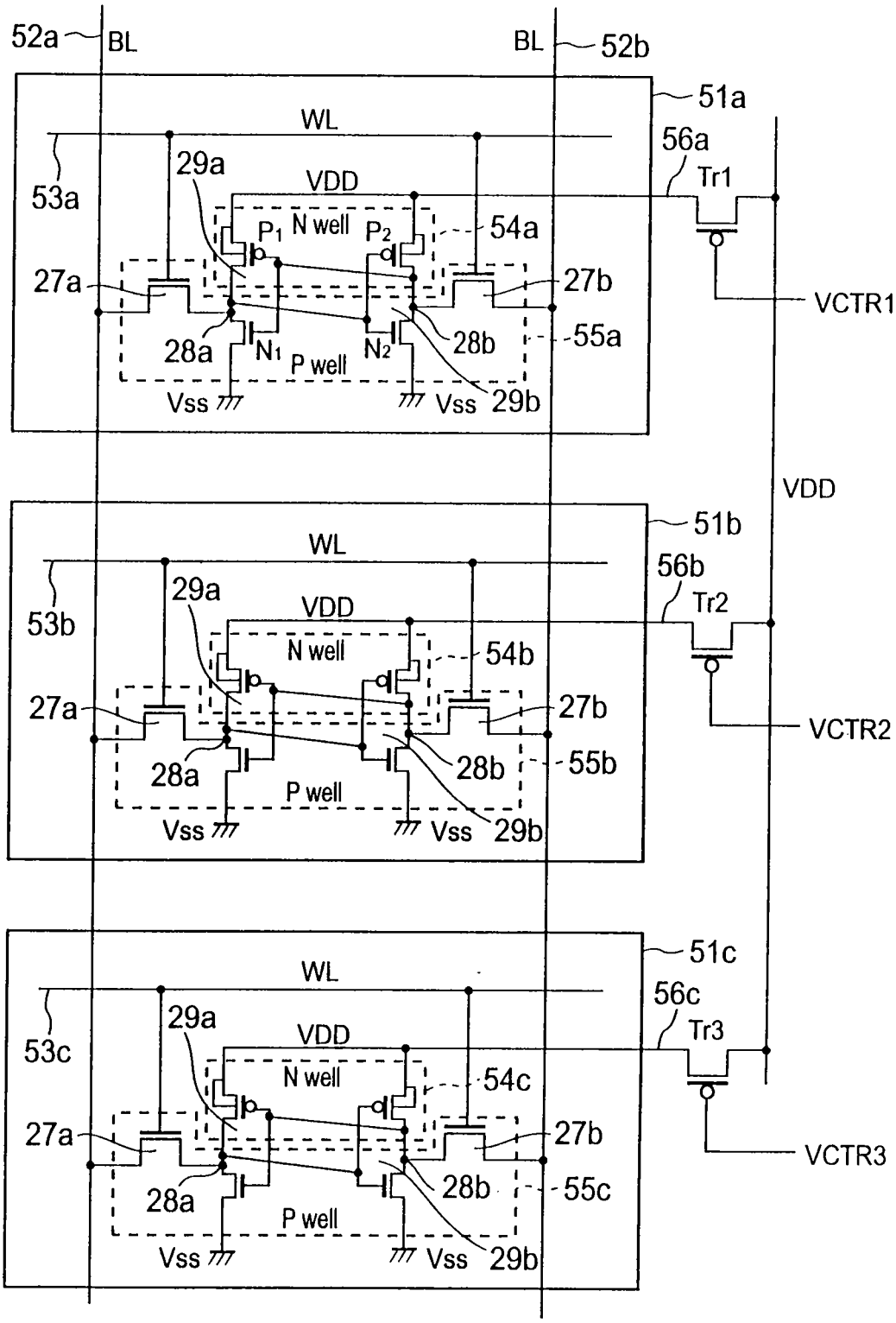
FIG. 5 is a view of the configuration of a display memory dividing a power supply according to a second embodiment.

FIG. 5 is a circuit diagram of the configuration of a display memory dividing the power supply.

In FIG. 5, the same reference numerals are used for part of the components the same as those of FIG. 2.

In FIG. 5, 51*a*, 51*b*, and 51*c* indicate memory cells of the display memory 7 according to the first embodiment shown in FIG. 2, 52*a* and 52*b* indicate a pair of bit lines (BL), 53*a*, 53*b* and 53*c* indicate word lines (WL), 54*a*, 54*b*, and 54*c* indicate N wells, and 55*a*, 55*b*, and 55*c* indicate P wells.

In the memory cell 51*a*, PMOS transistors P1 and P2 are formed at the N well 54*a*, and NMOS transistors N1, N2, 27*a*, and 27*b* are formed at the P well 55*a*.

The NMOS transistor N1 and the PMOS transistor P1 form a CMOS inverter circuit 29*a*, while the NMOS transistor N2 and the PMOS transistor P2 form a CMOS inverter circuit 29*b*. Inputs and outputs are cross-connected to each other so that this pair of CMOS inverters 29*a* and 29*b* form a flip-flop, whereby a bi-stable flip-flop circuit is obtained.

When supplying a drive voltage $V_{DD}$ to this pair of CMOS inverters 29*a* and 29*b* by a drive power supply line 56*a*, the above bi-stable flip-flop circuit holds two complementary stable states at the nodes 28*a* and 28*b*. The nodes 28*a* and 28*b* become storage nodes able to store data.

For example, the state where the node 28*a* is at the high level and the node 28*b* is at the low level is defined as meaning that the data "1" is stored, while conversely the state where the node 28*a* is at the low level and the node 28*b* is at the high level is defined as meaning that the information "0" is stored.

When reading this data, first, a word line voltage is supplied to the word line designated by a not illustrated row address decoder, for example, the word line 53*a*, to set the NMOS transistors 27*a* and 27*b* in the conductive state.

When reading data for every bit, a not illustrated column address decoder is used to designate the memory cells to be read, for example, memory cells 51*a*, 51*b*, and 51*c*. Along with the designation of the word line, the memory cell 51*a* will be selected. When reading data for every line or for every plurality of memory cells, for example, a memory cell line including the memory cell 51*a* or a plurality of memory cells is designated.

Since the NMOS transistors 27*a* and 27*b* become conductive in state, the states of the nodes 28*a* and 28*b* are transmitted to a not illustrated read sense amplifier connected to the pair of bit lines 52*a* and 52*b*.

When outputting the data stored in the memory to the liquid crystal panel, a not illustrated display use sense amplifier is used to extract the present state of the memory cell 51*a*. Further, when reading the data stored in the memory from the CPU 2, a not illustrated CPU 2 sense amplifier is used to extract the present state (data) of the memory cell 21.

Further, when writing data from the CPU 2 into the memory cell 51*a*, the line of the memory cell or a plurality of memory cells or one memory cell is selected as described above and the NMOS transistors 27*a* and 27*b* are set to the conductive state. Then, the write data input to the not illustrated write driver is stored at the two storage nodes 28*a* and 28*b* via the NMOS transistors 27*a* and 27*b*. Namely, when the value of the write data is "1", the storage node 28*a* is set to the high level and the storage node 28*b* is set to the low level, while when the value of the data is "0", the storage node 28*a* is set to the low level and the storage node 28*b* is set to the high level.

The memory cells 51*b* and 51*c* have exactly the same configurations as that of the memory cell 51*a* and operate in the same way as 51*a*. Therefore, in the memory cells 51*b* and 51*c*, the same reference numerals as those for the memory cell 51*a* are used for components other than the power supply.

Further, in the present embodiment, as shown in FIG. 5, PMOS transistors Tr1, Tr2, and Tr3 acting as power supply switches are connected to the drive power supply lines 56*a*, 56*b*, and 56*c* of the memory cells 51*a*, 51*b* and 51*c* and control the ON/OFF states of the power supply to the memory cells 51*a*, 51*b*, and 51*c*.

The N wells 54*a*, 54*b*, and 54*c* to which the drive power supply lines 56*a*, 56*b*, and 56*c* of the memory cells 51*a*, 51*b*, and 51*c* are connected are separated from each other. Further, the drive power supply lines 56*a*, 56*b*, and 56*c* are connected to the drive power supply lines 56*a*, 56*b*, and 56*c* of the PMOS transistors of the memory cells 51*a*, 51*b*, and 51*c* via the transistors Tr1, Tr2, and Tr3 for turning the power supply ON/OFF, therefore the supplies of power to the memory cells 51*a*, 51*b*, and 51*c* are separated from each other.

In FIG. 5, VDD controllers VCTR1, VCTR2, and VCTR3 control the ON/OFF states of the transistors Tr1, Tr2, and Tr3 and thereby control the ON/OFF states of the power supplies of the memory cells 51*a*, 51*b*, and 51*c*. This control is set by the operation modes of the VDD controllers VCTR1, VCTR2, and VCTR3.

Here, an example of three cells is shown, but the same also applies for the case of the division for more than three cells.

Further, one power supply switch transistor is provided in each memory cell here, but there is nothing stopping control of power supplies of memory cells of predetermined regions of the memory together in accordance with actual conditions.

According to the display memory of the second embodiment, by dividing the power supply for every predetermined region of the memory and independently controlling the on/off states of the power supplies, the leakage current of memory cells of the unused regions can be reduced.

Further, by separating N wells of memory cells, the supply of power to the unused regions of memory cells can be cut to reduce the power consumption.

Third Embodiment

The display memory according to the third embodiment has a similar basic configuration to that of the display memory of the first embodiment. Note, in the third embodiment, the address array of the display memory corresponds to the pixel array of the liquid crystal panel so the image of the image data stored in the display memory becomes the same as the screen of the liquid crystal panel. Further, the read or write access with respect to the display memory is carried out in units of one row's worth of the pixel data on the screen.

Figure 6:
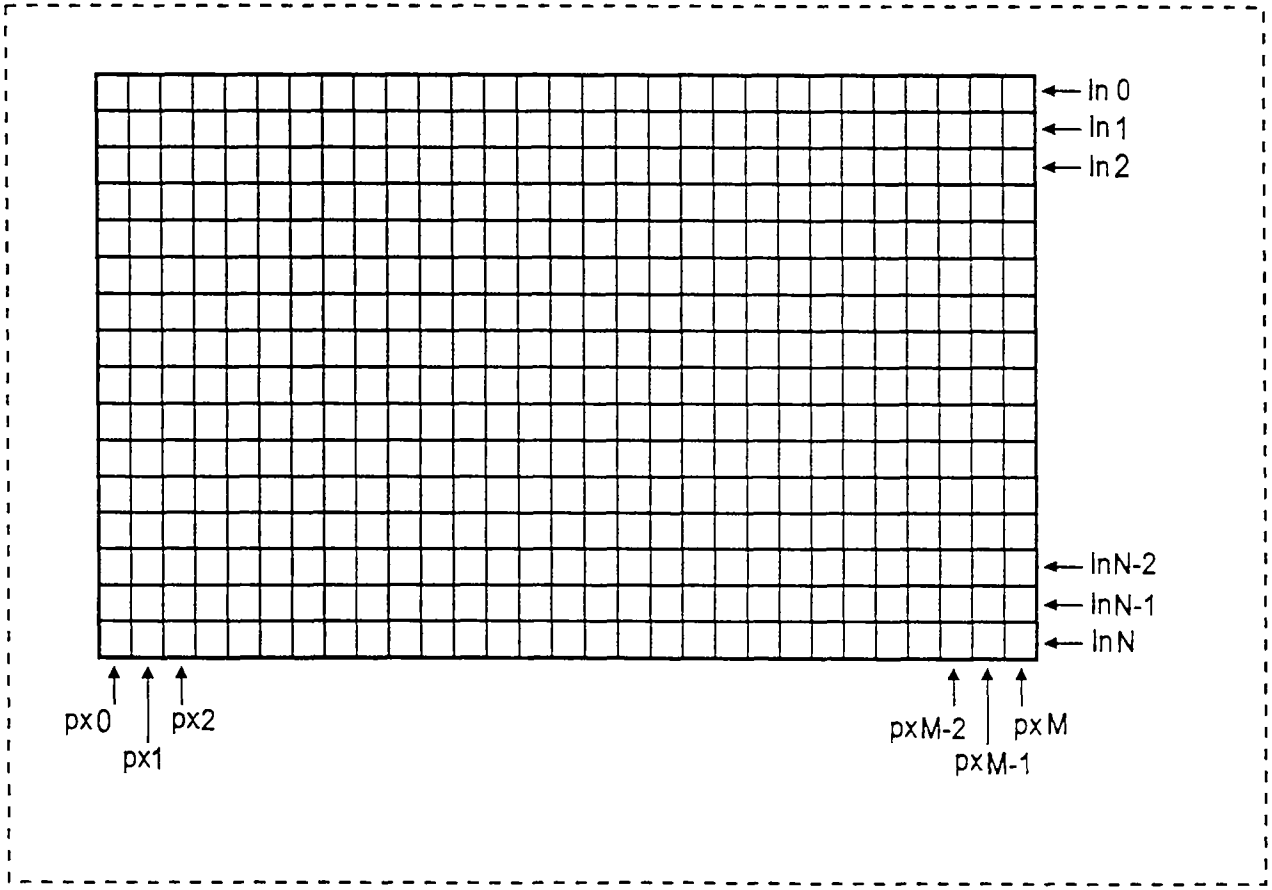
FIG. 6 is a schematic view of an address array of the display memory and the array of pixels on a display screen according to a third embodiment.

FIG. 6 is a schematic view of the address array of the display memory and the array of pixels of the liquid crystal panel according to the third embodiment.

In FIG. 6, the address array of the memory and the pixel matrix of the liquid crystal panel are expressed by an array having lines 1*n*0 to 1*n*N and pixels px0 to pxN as suffixes. The arrays of addresses of the memory and pixels of the liquid crystal panel become the same in image. Namely, addresses of the memory are distributed according to the array of pixels of the liquid crystal panel. For example, the number of memory cells connected to one word line of the memory and the number of memory cells connected to a pair of bit lines are determined according to the number of pixels of one row of the liquid crystal screen, the number of pixels of one column, and the number of bits of the colors of the pixels.

By the array of addresses of the memory and the array of pixels of the liquid crystal panel becoming the same, the data of pixels to be accessed can be designated among the data stored in the memory having the lines 1*n*0 to 1*n*N and pixels px0 to pxN as suffixes. The CPU 2 designates the line address and pixel address and reads and writes data. When displaying data on a liquid crystal panel, it operates to designating the line address and read one line's worth of data together.

Next, a read or write operation in units of rows of pixel data will be concretely explained.

Figure 7:
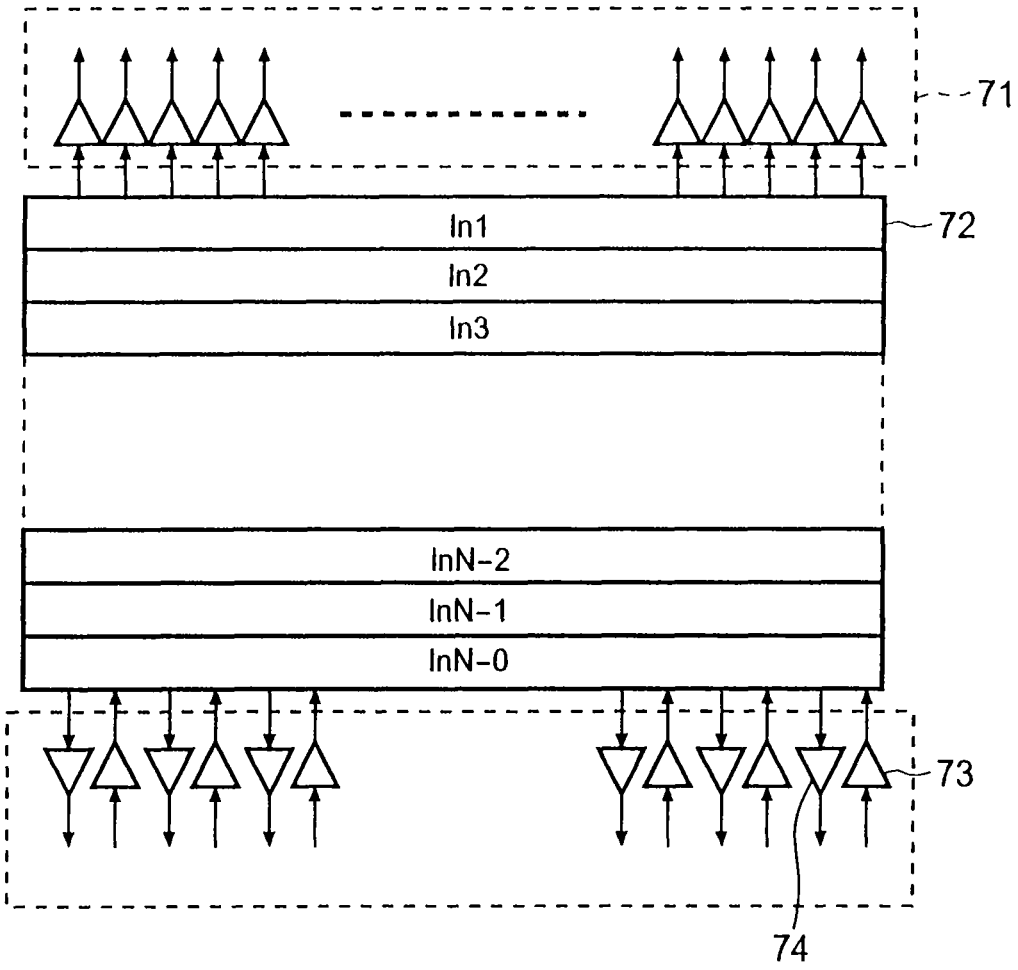
FIG. 7 is a view of the configuration for accessing a display memory in units of lines according to the third embodiment.

FIG. 7 shows the configuration for accessing the display memory for every line.

In FIG. 7, 71 indicates a plurality of display use sense amplifiers, 72 indicates one line's worth of memory cells of the liquid crystal panel, 73 indicates a plurality of write drivers for the CPU, and 74 indicates a plurality of sense amplifiers for the CPU.

One line's worth of memory cells 72 of the liquid crystal panel becomes the unit of the transfer data when reading and writing data. Data is read and written by this amount of data. Display use sense amplifiers 71 are provided in a number of the amount of one row's worth of pixels of the liquid crystal panel. When reading data stored in the display memory and outputting the same to the liquid crystal panel, these sense amplifiers all operate at one time.

The CPU use write drivers 73 are provided in the same number as the display use sense amplifiers 71. When the CPU 2 reads data stored in the display memory, these write drivers 73 also all simultaneously operate.

The CPU use sense amplifiers 74 are provided in the same number as the display use sense amplifiers 71 or the CPU use write drivers 73. When the CPU 2 writes data into the display memory, these sense amplifiers all simultaneously operate.

Note that at the time of writing, the write drivers can simultaneously write data into required portions (bits or predetermined plurality of bits) according to the write control signal for every bit explained later.

In the present embodiment, by employing simple mapping able to handle the pixel array of the liquid crystal panel and the memory address array by the same suffixes, the calculation for linking the addresses and the pixels of the liquid crystal panel becomes unnecessary and liquid crystal panels having a variety of numbers of pixels can be easily handled.

Further, the number of times of reading of the memory for one line's worth of the display may be one time. Further, the display memory has a circuit enabling access from the CPU 2 in units of rows and access to the pixel information in that as well. Namely, the operation of the memory is based on access for one line's worth of data. By this, the number of times of operation of the memory can be reduced and low power consumption can be realized.

Fourth Embodiment

In the conventional display memory, when writing predetermined bits, a read-modify-write operation is necessary. Namely, in the conventional display memory, the data is read out in advance before rewriting the data, the bits to be rewritten are modified while masking the data which are not desired to be rewritten, and then the data is written into the memory.

In the third embodiment, an explanation will be given of a display memory providing a column decoder designating a memory cell in the bit direction and a write signal for controlling the write operation on the above display memory and enabling selection of any one memory cell and writing of any bits.

The display memory in the present embodiment has the basic configuration of the display memory of the first embodiment.

Figure 8:
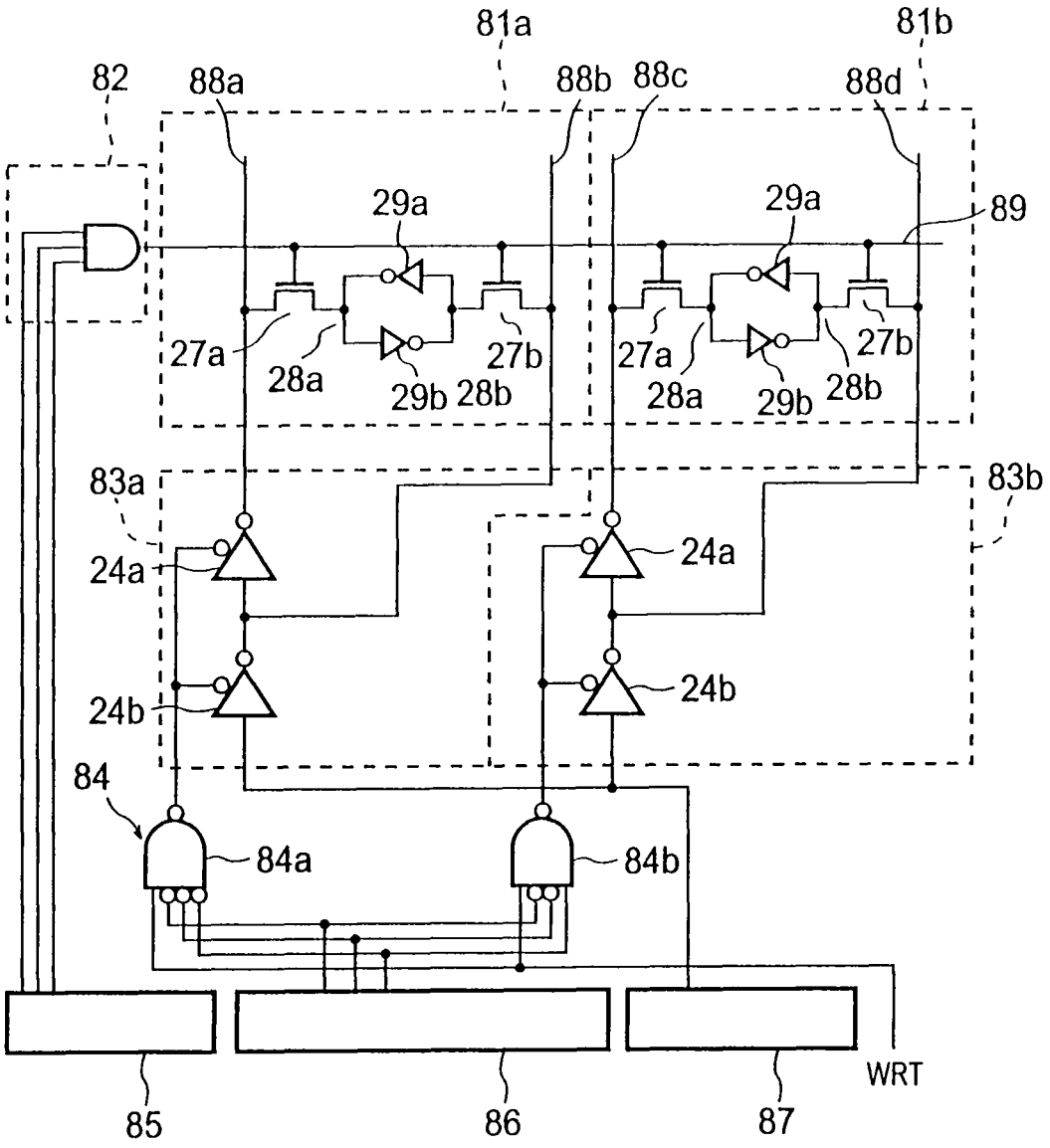
FIG. 8 is a view of the configuration of principal parts of a display memory able to write data for every bit according to a fourth embodiment.

FIG. 8 is a view of principal parts of a display memory according to the present embodiment.

In FIG. 8, the same reference numerals are used for part of the components the same as those of FIG. 2.

In FIG. 8, 81*a* and 81*b* indicate memory cells, 82 indicates the row decoder of the memory, and 83*a* and 83*b* indicate write drivers of the memory cells 81*a* and 81*b*.

Further, 84*a* and 84*b* indicate column decoders, 85 indicates a read row address latch, 86 indicates a pixel address latch, and 87 indicates a write data latch. Reference numerals 88*a* and 88*b* and reference numerals 88*c* and 88*d* indicate pairs of bit lines of the memory cells 81*a* and 81*b*, and 89 indicates a word line common to the memory cells 81*a* and 81*b*.

In FIG. 8, the memory cell 81*a* has two inverters 29*a* and 29*b* having inputs and outputs connected to each other and has NMOS transistors 27*a* and 27*b* as access transistors. A first storage node 28*a* is configured by the connection point of the output of the inverter 29*a* and the input of the inverter 29*b*, while a second storage node 28*b* is configured by the connection point of the input of the inverter 29*a* and the output of the inverter 29*b*.

The bit line 88*a* is connected via the NMOS transistor 27*a* to the first storage node 28*a*, while the bit line 88*b* is connected via the NMOS transistor 27*b* to the second storage node 28*b*. Gates of the NMOS transistors 27*a* and 27*b* of the memory cell 81*a* are connected to the common word line 89.

The write circuit 83*a* has first drivers 24*a* and 24*b* connected in series and operating by a control signal comprised of the low level, active output of the column decoder 84*a*.

The row address decoder 82 outputs the word line voltage to the common word line of a predetermined memory cell row based on the row address data of the read row address latch 85 and sets the NMOS transistors 27*a* and 27*b* to the conductive state. Based on the column address data of the pixel address latch 86, the output of the column address decoder 84*a* is inverted and input to the write drivers 24*a* and 24*b* of the memory cell column to be written in the bit direction to actuate them.

The write signal WRT is input to the column decoder circuits 84*a* and 84*b*. The column decoders 84*a* and 84*b* operate only in the case where the write signal WRT is at the high level.

Next, the operation of a memory having the above configuration will be explained.

When supplying the drive voltage $V_{DD}$ to the pair of CMOS inverters 29*a* and 29*b*, the CMOS inverters 29*a* and 29*b* forming a bi-stable flip-flop circuit hold two complementary stable states at the nodes 28*a* and 28*b*, whereby the nodes 28*a* and 28*b* can store data.

For example, the state where the node 28*a* is at the high level and the node 28*b* is at the low level is defined as meaning the data "1" is stored, while conversely the state where the node 28*a* is at the low level and the node 28*b* is at the high level is defined as meaning the data "0" is stored.

Since the NMOS transistors 27*a* and 27*b* have become conductive in state, the nodes 28*a* and 28*b* are connected to the write driver 83*a* via the pair of bit lines 88*a* and 88*b* and data can be written.

For example, when writing data into the memory cell 81*a* from the CPU 2, based on the row address data of the read row address latch 85, the row address decoder 82 selects for example the word line 89, supplies voltage to the word line 89, and thus sets the NMOS transistors 27*a* and 27*b* to the conductive state.

Next, based on the column address data of the pixel address latch 86, the column address decoder 84*a* designates the memory cell to be written in the bit direction. For example, assume that the memory cell 81*a* is designated. Along with the designation of the word line, the memory cell 81*a* will be selected.

In the fourth embodiment, the write signal WRT for controlling the write operation to a memory cell is input to the column decoder circuits 84*a* and 84*b*. Only when the write signal WRT is at the high level is the writing into the memory cell designated by the column decoders 84*a* and 84*b* possible.

For example, as described above, when the memory cell 81*a* is selected and the write signal WRT is at the high level, the output of the column decoder device 84*a* becomes the low level and enables the operation of the write driver 83*a*. Accordingly, the data held in the write data latch 87 can be written into the memory cell 81*a* designated by the row decoder 82 and the column decoder 84.

As shown in FIG. 8, the write driver 84*a* has a first write driver 24*a* and a second write driver 24*b*. The data held in the write data latch 87 are input to the write driver 84*a* one after another. The data of each bit thereof is first inverted at the second write driver 24*b* and stored at the storage node 28*b* via the now on NMOS transistor 27*b*.

The inverted output of the second write driver 24*b* is input to the first write driver 24*a* and further inverted and stored at the storage node 28*a* via the now on NMOS transistor 27*a*.

For example, when the value of the write data is "1", it becomes "0" by the output of the second write driver 24*b* and is stored at the storage node 28*b*. The output "0" of the second write driver 24*b* is input to the first write driver 24*a*, whereby "1" is output and stored at the storage node 28*a*.

When the value of the write data is "0", similarly, "0" is stored at the storage node 28*a*, and "1" is stored at the storage node 28*b*.

On the other hand, when the write signal WRT is at the low level, the output of the decoder device 84*a* designating the memory cell 81*a* becomes the high level, and the write driver 83*a* of the memory cell 81*a* becomes unable to operate. Accordingly, the data held in the write data latch 87 cannot be written into the memory cell 81*a* designated by the row decoder 82 and the column decoder 84.

The memory cell 81*b* operates in the same way.

The display memory of the fourth embodiment has a write control signal (write signal) for every bit. The CPU 2 can write any one bit into the display memory based on this control signal. When comparing this with the conventional display memory, similar effects are realized by just a write operation without performing a read operation in advance.

According to the fourth embodiment, by using a write system not requiring a read-modify-write operation, the number of times of operation of the memory can be reduced. Due to this, the power consumption of the memory can be reduced.

Fifth Embodiment

As already explained, in the display memory of the present invention, terminals are arranged on facing sides of the memory while sandwiching the memory therebetween, therefore one terminal can be arranged for the CPU, and another terminal can be arranged for the liquid crystal panel.

The liquid crystal driver of the present invention has a configuration wherein the CPU use interface and the liquid crystal panel use interface sandwich the display memory and are arranged at the two ends of the display memory. It has a CPU use interface between the display memory and the CPU 2 and has a liquid crystal panel use interface between the display memory and the liquid crystal panel.

The fifth embodiment relates to the data transfer between the CPU use interface and the display memory.

Figure 9:
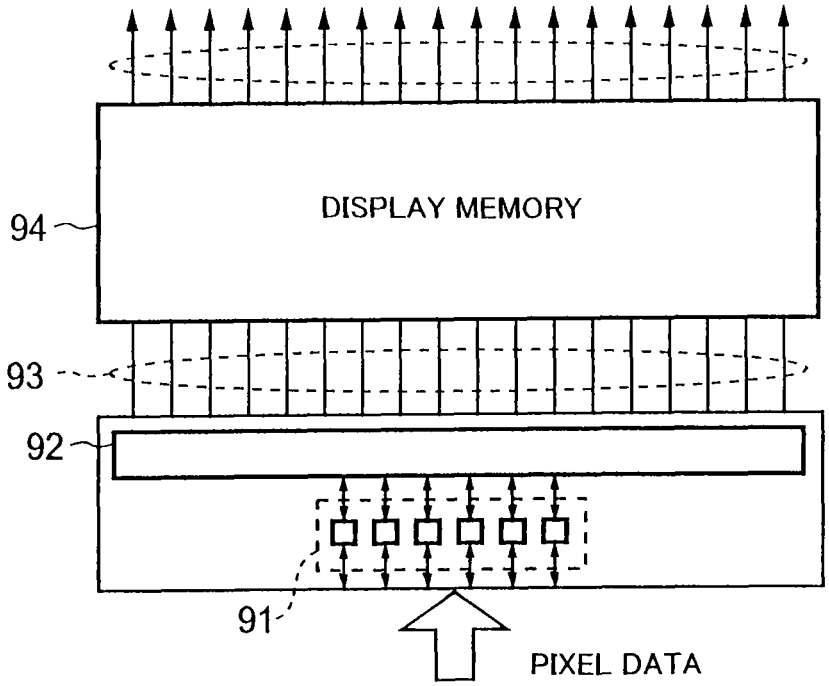
FIG. 9 is a view of the schematic circuit configuration on a CPU side of a driver circuit according to a fifth embodiment.

FIG. 9 is a view of the schematic circuit configuration of the part on the CPU side of the liquid crystal driver according to the fifth embodiment.

In FIG. 9, 91 indicates a line latch circuit, 92 indicates a selector circuit, 93 indicates a data bus, and 94 indicates a display memory.

The image data is sent from the CPU 2 or the logic circuit for every pixel. The pixel data sent for every pixel is first stored in a data latch 91. When one line of the liquid crystal panel's worth of data is stored in the data latch 91, that data is output to the selector 92, selected there, and written into the display memory 94 via the data bus 93.

Alternatively, when the CPU 2 reads the pixel data stored in the display memory 94, the pixel data stored in the display memory 94 is held in the data latch 91 in units of one line's worth of the data through the data bus 94 and via the selector 92, then the data held in the data latch 91 is read to the CPU 2 for every pixel.

The data of the display memory 94 is read to the liquid crystal panel side and displayed.

The bit width of the line latch 91 is the same as the bit width of one line's worth of the image data in the horizontal direction of the display screen.

For example, when the size of the liquid crystal panel is 176 pixels×240 rows, the data of each of the three colors of R, G, B is expressed by 6 bits, and display of 260,000 colors is possible, the required capacity of the memory becomes 176×3×6×240=760,320 bits and the data capacity and bit width of the line latch 91 become 176×3×6×1=3168 bits.

The data bus 93 has the same bit width.

FIGS. 10A to 10F show timing charts of the write operation by units of lines according to the circuit configuration of FIG. 9.

FIG. 10A shows 1 pixel's worth of the image data DAT sent from the CPU side; and FIGS. 10B and 10C show addresses ADD-X and ADD-Y in the X-direction (column direction) and in the Y-direction (row direction) in the display memory 94. FIG. 10D shows a write command XLATW from the CPU 2 to the line latch 91; FIG. 10E shows a write command XRAMW from the line latch 91 to the display memory 94; and FIG. 10F shows latch data LDAT.

Note that it is also possible to read out the stored data of the line latch 91 to the CPU side.

One line's worth of the image data is input from the CPU side while designating the X-address for every pixel. At this time, "L" is input as the write command to the line latch 91, and the image data of pixels are sequentially stored at locations corresponding to X-addresses in the line latch 91. After one line's worth of the image data is stored in the line latch 91, when the Y-addresses are designated and the write command XRAMW to the display memory 94 is set to "L", the one line's worth of the image data stored in the line latch 91 are written at the locations designated by the Y-addresses of the display memory 94.

Here, the read command from the line latch 91 to the display memory 94 is made XRAMR.

FIGS. 11A to 11F show timing charts of the read operation of units of lines according to the circuit configuration of FIG. 9.

FIGS. 11A and 11B show addresses ADD-X and ADD-Y in the X-direction (column direction) and in the Y-direction (row direction) in the display memory 94. FIG. 11C shows a read command XLATR from the line latch 91; FIG. 11D shows a read command XRAMR from the line latch 91 to the display memory 94; FIG. 11E shows latch data LDAT; and FIG. 11F shows read one pixel's worth of the image data DAT.

When the CPU side designates the Y-addresses of the locations of the display memory 94 from which the data are desired to be read out and sets the read command XRAMR to "L", the data at the locations designated by the Y-addresses in the display memory 94 are read out and one line's worth of the data is stored in the line latch 91. After one line's worth of the data is stored in the line latch 91, the read command XLATR from the line latch 91 is set to "L" and the X-address is designated for every pixel, to thereby read out the data stored in the line latch 91.

In this way, the read and write access with respect to the memory can be carried out in units of one line.

By providing one line's worth of the line latch between the display memory and the CPU 2, operations of reading and writing with respect to the display memory are simultaneously carried out for the amount of one line. By this, the number of times of access to the display memory is reduced. The operating power consumption of the display memory is proportional to the number of times of access, so a lower power consumption can be realized.

Sixth Embodiment

In the liquid crystal driver according to the sixth embodiment, based on the configuration of the fifth embodiment, the array of the pixels on the liquid crystal panel and the array of addresses of the display memory and the addresses of the data in the line latch are brought into one-to-one correspondence. Further, the data can be written from the line latch into the display memory for every pixel.

This is similar to the display memory explained in the third embodiment in the point that the array of pixels on the liquid crystal panel and the array of addresses of the display memory are in a one-to-one correspondence in the liquid crystal driver of the sixth embodiment.

Namely, a display memory having X-directional and Y-directional addresses corresponding to X- (column), Y- (row) coordinates on the liquid crystal panel is provided, and the X-, Y-coordinates on the display panel and the X-directional and Y-directional addresses of the display memory are set into one-to-one correspondence.

Next, an explanation will be given of the write operation for every pixel from the line latch to the display memory in the liquid crystal driver of the present embodiment by using FIG. 12 and FIG. 13 while referring to the timing charts of FIG. 10.

Figure 12:
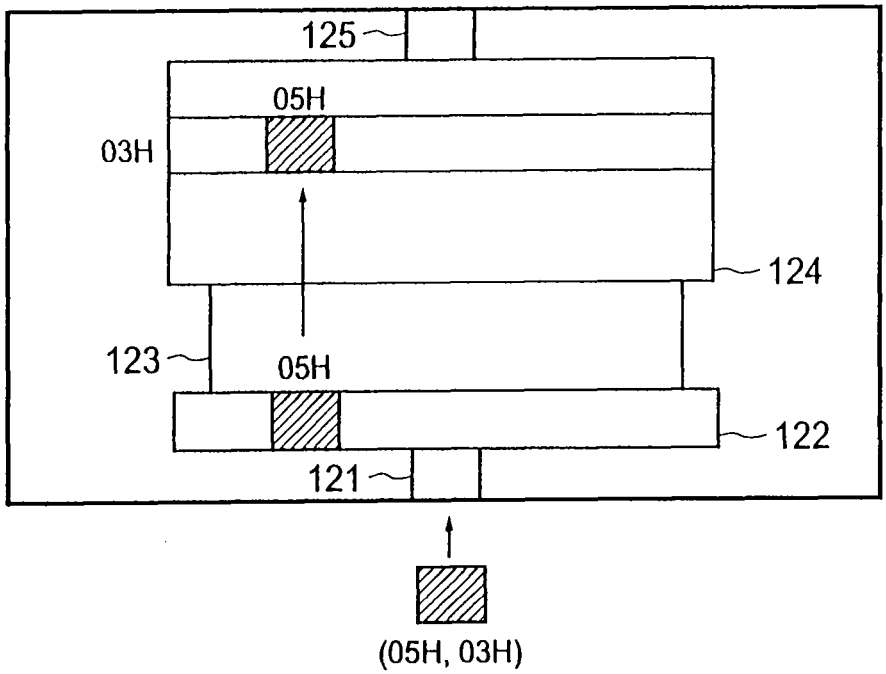
FIG. 12 is a view of the schematic circuit configuration at the time of the writing for every pixel of the driver circuit according to a sixth embodiment.

FIG. 12 shows the operation of writing data for every pixel.

In FIG. 12, 121 indicates a data bus of the image data sent from a CPU 2 or the logic circuit (one pixel's worth of the number of bits of data), 122 indicates a line latch, 123 indicates a data bus for reading the data to the display memory from the line latch 122 or writing the data (one line's worth of the number of bits of data), 124 indicates a display memory, and 125 indicates a data bus for sending the data to the liquid crystal panel side for displaying the data of the display memory.

The display memory 24 has X-directional and Y-directional addresses corresponding to the X-, Y-coordinates on the not illustrated liquid crystal panel. The sizes in the X-direction and Y-direction are data sizes in the X-direction and Y-direction of one screen.

The line latch 122 stores one line's worth of the data from the not illustrated CPU 2. The X-directional positions of this line latch 122 and X-directional addresses in the memory 125 and the X-coordinate on the screen are in one-to-one correspondence.

Next, the operation of writing the image data at addresses (05H, 03H) of the display memory 124 will be explained as an example.

First, when writing data by designating the image data and X-address (05H) from the CPU side (that is, XLATW="L" in FIG. 10), the image data is stored at the location indicated by the address 05H on the line latch 122. After the image data is simultaneously written into the line latch 122, if the Y-address (03H) is designated as the write command XRAMW="L", the color data of 1 pixel is written at the address positions of (05H, 03H) in the memory.

Next, using FIG. 13, the technique for realizing an operation of writing data into the display memory 124 for every pixel described above will be explained.

Figure 13:
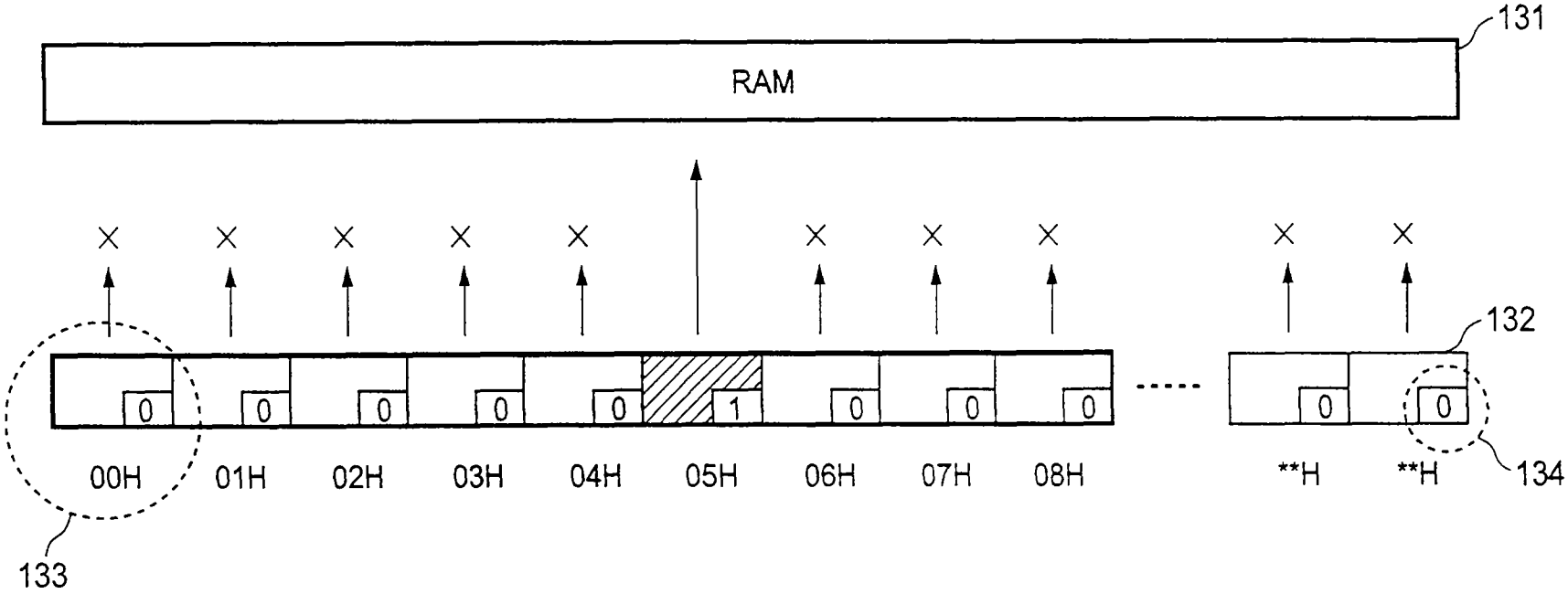
FIG. 13 is a view of the configuration enabling writing of data into the display memory for every pixel in the driver circuit according to the sixth embodiment.

In FIG. 13, 131 indicates part of the display memory, and 132 is the line latch.

In the line latch 132, 133 is the storage region occupied by one pixel, and 134 is a write flag provided for every pixel.

As shown in FIG. 13, at the line latch 132, a write flag for writing data from the line latch 132 into the display memory 131 is provided for the address of each pixel. The write flag is set (that is, WRITE FLAG=1) for only a pixel for which data is written from the CPU side to the line latch 132. When writing data into the display memory 131, data is written for only pixels where the write flag is "1", therefore it is possible to write data for only the desired pixels and there is no effect on the surrounding pixel data.

Further, it is also possible to rewrite the data for any plurality of pixels on the same line by using these write flags.

After writing the data from the line latch 132 into the display memory 131, the write flags are all reset to "0".

FIGS. 14A to 14F are timing charts of the above operation.

Figure 14:
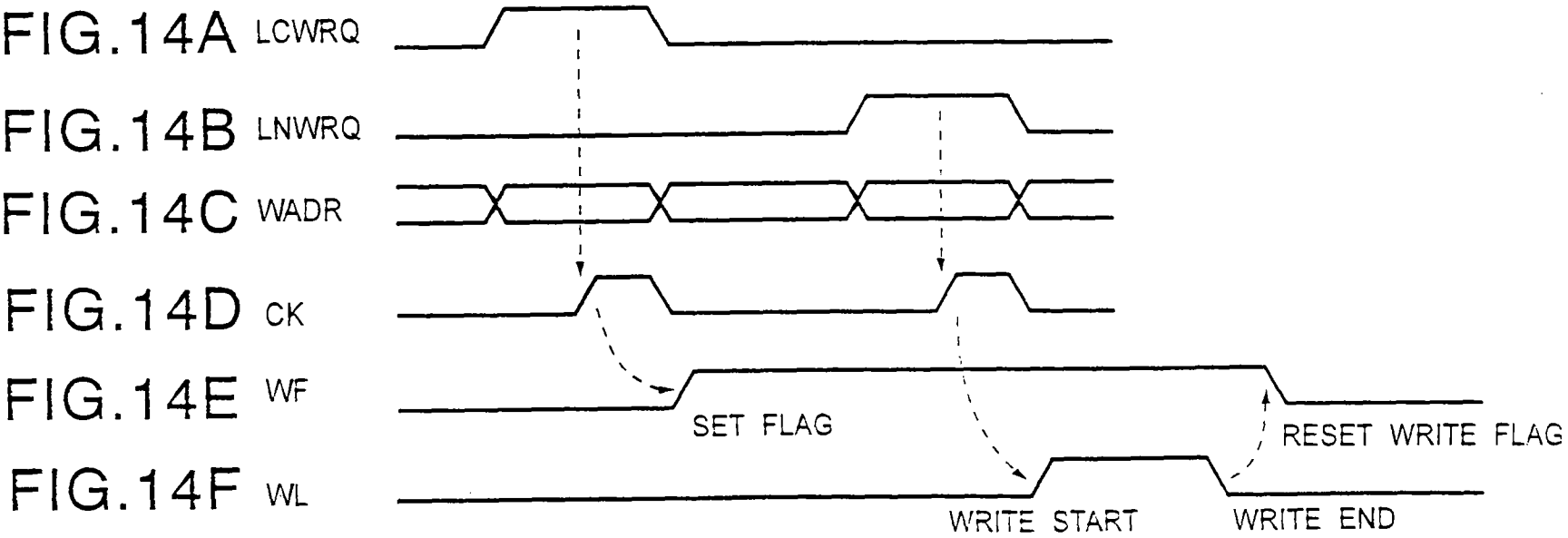
FIGS. 14A to 14F are timing charts of an operation for writing data into the display memory for every pixel using a write flag signal according to the sixth embodiment.

FIG. 14A shows a latch write signal LCWRQ; FIG. 14B shows a line write signal LNWRQ; and FIG. 14C shows a write address signal WADR, a clock signal CK, a write flag signal WF, and a word line signal WL.

As shown in FIGS. 14A to 14F, when writing data for a pixel of the line latch 132 indicated by the write address signal WADR, the latch write signal LCWRQ for the pixel becomes the high level. That is, LCWRQ becomes equal to "1".

Then, the write flag signal WF of the pixel is set, that is, becomes the high level (WF="1").

The line write signal LNWRQ is set and becomes the high level for the pixel of the memory 131 corresponding to the pixel where the write flag WF="1". Namely, LNWRQ becomes equal to "1".

A voltage is supplied to the word line WL designated by the write address signal WADR of the display memory 131, writing to a pixel of the memory related to this word line WL is enabled, and then the writing starts.

Namely, when writing data into the display memory 131, the data is written into only a pixel corresponding to a pixel where the write flag WF="1" of the line latch 132 of the display memory 131 (LNWRQ="1").

It is also possible to rewrite any plurality of pixels on the same line by using the write flags.

After writing the data from the line latch 132 into the display memory 131 (Write End), the write flag WF is reset to "0".

Conventionally, the read/write operation with respect to the display memory is carried out for every group of pixels, therefore, when desiring to write data for a certain single pixel in the display memory from the CPU 2, if trying to write one pixel's worth of data as it is, the plurality of pixels around that will be rewritten. Therefore, the read-modify-write sequence of reading a group of pixels once, then rewriting only the data of pixels desired to be rewritten outside the memory, and again storing the rewritten group of pixels in the memory has been performed.

By imparting the write flags WF to the line latch as in the sixth embodiment, it is possible to rewrite data for only pixels desired to be written.

By imparting the write flags WF to the line latch for every pixel, it is possible to write the desired pixel data without any effect upon the pixel data around the pixels to be written. Therefore, according to the sixth embodiment, there is the advantage that the read-modify-write sequence which has been conventionally required becomes unnecessary.

Further, it is not necessary to generate memory addresses corresponding to X-, Y-coordinates on the screen outside the display memory. Image data can be written in units of pixels at the locations of the memory corresponding to the screen by just designating the X-, Y-coordinates on the screen as X-, Y-addresses from the CPU side. Further, when writing data for a plurality of pixels existing on the same line, the line latch and the display memory need only be accessed one time.

Seventh Embodiment

As already explained, in the display memory of the present invention, terminals are arranged at the facing sides of the memory while sandwiching the memory therebetween, therefore one terminal can be arranged for the CPU, and another terminal can be arranged for the liquid crystal panel.

The liquid crystal display of the present invention is configured with the CPU use interface and the liquid crystal panel use interface sandwiching the display memory therebetween and arranged at the two ends of the display memory. It has the CPU use interface between the display memory and the CPU 2 and has the liquid crystal panel use interface between the display memory and the liquid crystal panel.

The seventh embodiment relates to the data transfer from the display memory to the liquid crystal panel use interface.

Figure 15:
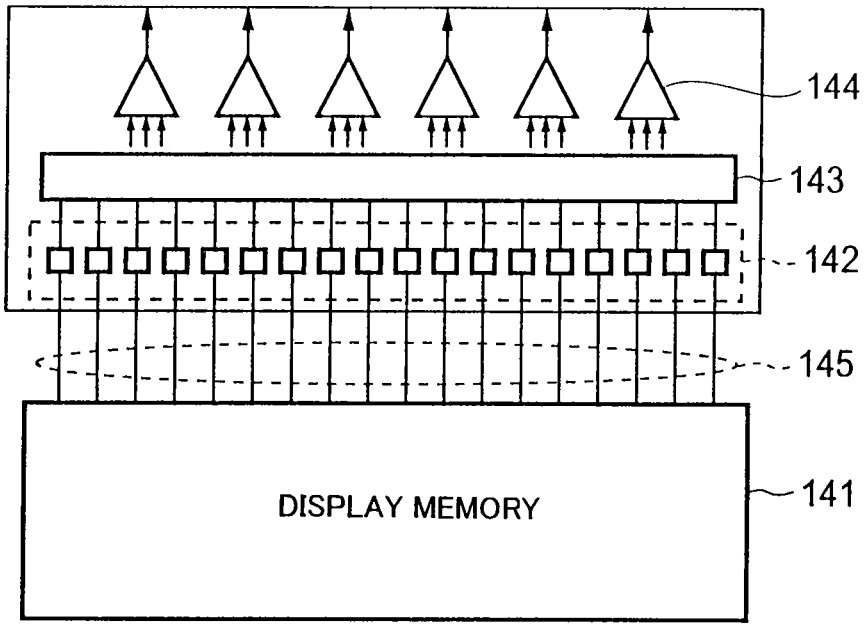
FIG. 15 is a view of the schematic circuit configuration on a display screen side of the driver circuit according to a seventh embodiment.

FIG. 15 is a view of the circuit configuration of the part on the panel side of the liquid crystal display according to the seventh embodiment.

In FIG. 15, 141 indicates a display memory, 142 indicates a data latch circuit, 143 indicates a selector circuit, and 144 indicates a digital/analog converter (DAC).

Reference numeral 145 indicates a data bus for the liquid crystal panel. Pixel data is read out to a not illustrated liquid crystal panel from the display memory 141 through the data bus 145 for the liquid crystal panel.

The line latch 142 can store one line's worth of the data in the horizontal direction on the screen. The bit width is the same as one line's worth of the bit width.

For example, when the size of the liquid crystal panel is 176 pixels×240 rows, the data of each of the three colors of R, G, B is expressed by 6 bits, and display of 260,000 colors is possible, the required capacity of the memory becomes 176×3×6×240=760,320 bits and the data capacity and bit width of the line latch 142 become 176×3×6×1=3168 bits.

When reading out the pixel data stored in the display memory 141 and displayed it on the liquid crystal panel, data is held in the data latch 142 through the data bus 145 in units of one line's worth of the pixel data in the horizontal direction of the not illustrated liquid crystal panel. Then, the data held in the data latch 142 is output to the selector 143. The selector 143 sequentially selects the R, G, B portions of each pixel data by a predetermined system, outputs them to the DACs 144, and further outputs them to the pixels of the liquid crystal panel. Due to this, the pixel data is displayed on the screen.

In this way, the line latch 142 performs a series of operations for fetching one line's worth of the data in the horizontal direction on the liquid crystal screen from the display memory 145 in a constant cycle and outputting the same to the DACs 144.

Further, the operation of writing one line's worth of the data held in the display memory 145 into the line latch 142 is carried out in synchronization with a clock of the display memory.

After holding one line's worth of the data in the line latch 142, the memory 145 can be freed up, so the time after that can be used for the access time of the CPU 2. As a result, a moving picture display etc. requiring quick switching of the screen can also be handled.

As described above, in the liquid crystal driver having the built-in display memory, in order to drive one line in the horizontal direction on the liquid crystal panel screen at a time, a latch circuit for holding the data of simultaneously operating DACs is necessary.

By providing a latch circuit having a capacity required for holding one line's worth of the data in the horizontal direction on the liquid crystal panel screen between the display memory and the DACs, it becomes possible to read and write one line's worth of data in the horizontal direction on the liquid crystal panel screen at one time, the number of times of access to the memory is reduced, and thus a lower power consumption can be achieved.

Eighth Embodiment

The configuration of the liquid crystal display according to the eighth embodiment is substantially the same as that of the seventh embodiment. The difference thereof resides in that a selector circuit able to output data in a time division manner for three colors of red, green, and blue (RGB time division) when outputting data held in the data latch to the digital/analog converters (DACs) (hereinafter, referred to as a RGB selector) is included.

Figure 16:
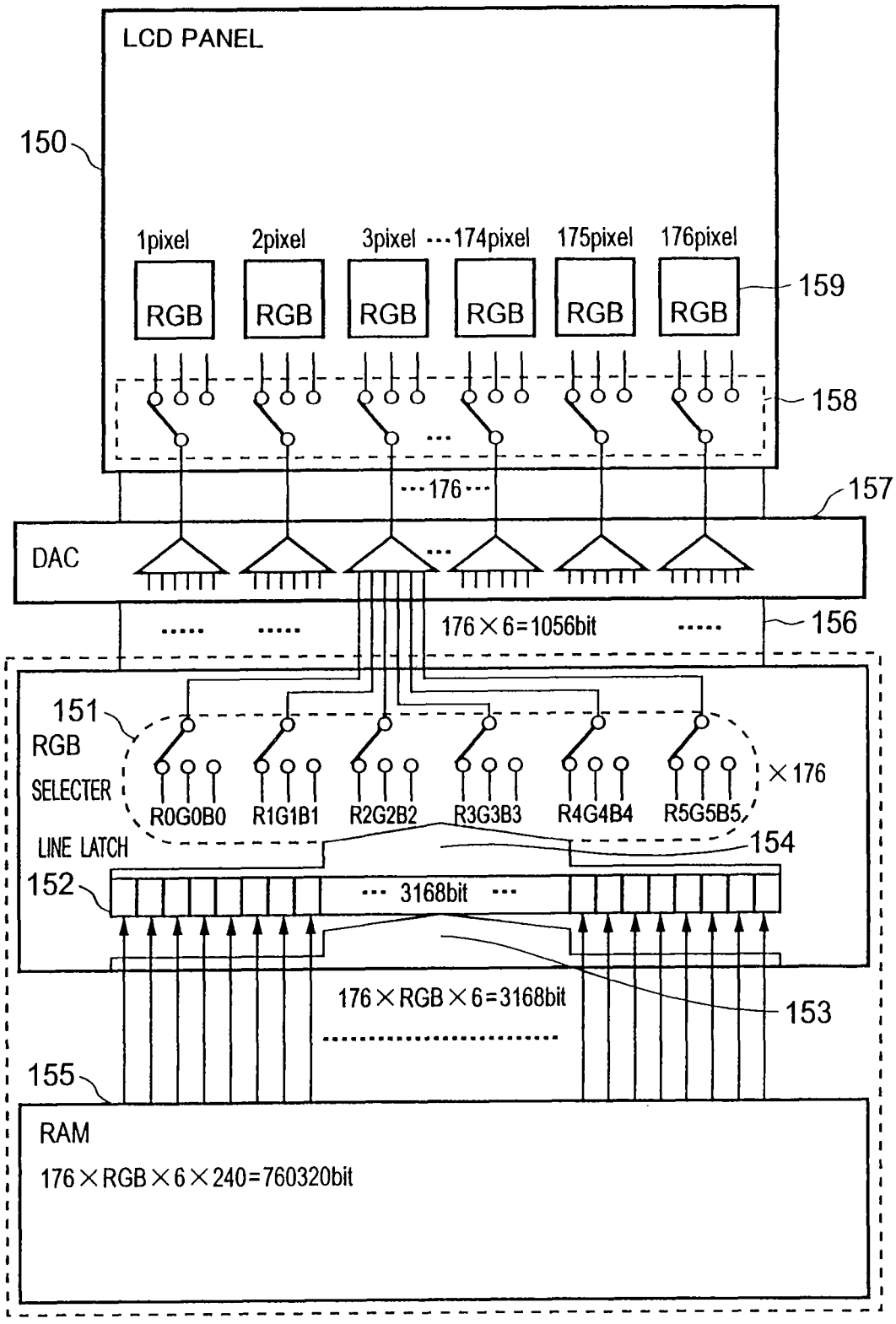
FIG. 16 is a view of the configuration of principal parts of a display according to an eighth embodiment.

FIG. 16 is a circuit diagram of the configuration of the principal parts of a liquid crystal display according to the eighth embodiment.

In FIG. 16, 150 indicates a liquid crystal panel, 151 indicates an RGB selector circuit, 152 indicates a line latch circuit, 153 indicates a data bus for the image data sent from the display memory, 154 indicates a data bus for the image data output from the line latch 152, 155 indicates a display memory, 156 indicates the data bus for the image data output from the selector circuit 151, 157 indicates a digital/analog converter (DAC), 158 indicates a selector circuit for converting the image data having red, green, and blue colors divided by the RGB selector 151 to the parallel data of R, G, B, and 159 indicates a pixel cell expressed by red, green, and blue colors.

The liquid crystal display having the above configuration operates as follows.

The image data sent from the display memory 155 is output to the line latch 152 and held there in units of lines. The data held in the line latch 152 is output to the DACs 157 in synchronization with the horizontal synchronization signal (Hsync). At that time, the R, G, B components of the image data are switched by the RGB selector 151 asynchronously with respect to the clock of the memory, time divided, and then output to the DACs 157. By this, the number of the output terminals of the selector 151 and DACs 157 becomes one-third of the bit width of the line latch 152. The R, G, B data in the time-divided image data output from the DACs 157 are separated by the selector circuit 158 to become the parallel data of R, G, and B which are in turn output to the pixel cells 159 for display.

For example, as explained above, when the size of the liquid crystal panel 150 is 176 pixels×240 rows, each of the data of the three colors of R, G, B is represented by 6 bits, and the display of 260,000 colors is possible, the RGB selector 151 has input terminals for 3168 bits or the same as the bit width of the line latch 152 and, for one DAC 157, switches R, G, B data each consisting of 6 bits by time division and outputs the same. Accordingly, the selector 151 has output terminals for 1056 bits.

The data held in the line latch 152 is output to the DACs 157 in synchronization with the horizontal synchronization signal (Hsync). At that time, the R, G, B components of the color image data are switched at the RGB selector 151, time divided, and output.

Conventionally, when outputting the data of a memory to DACs, the data was not output by the time division of the RGB data, but the outputs of the memory were directly connected to the DACs by one-to-one correspondence.

According to the eighth embodiment, by outputting the image data by time division by RGB, in comparison with the case where the outputs of the line latch 152 are directly connected to the DACs 157 by one-to-one correspondence, the number of DACs 157 can be decreased to one-third.

Further, when outputting the data held in the line latch 152 to the digital/analog converters (DAC) 157, the switching of RGB of the image data of color is controlled asynchronously with respect to the clock of the memory.

FIGS. 17A to 17F show timing charts of the RGB time division of the output data of the line latch 152.

Figures 17A, 17B, 17C, 17D, 17E, 17F:
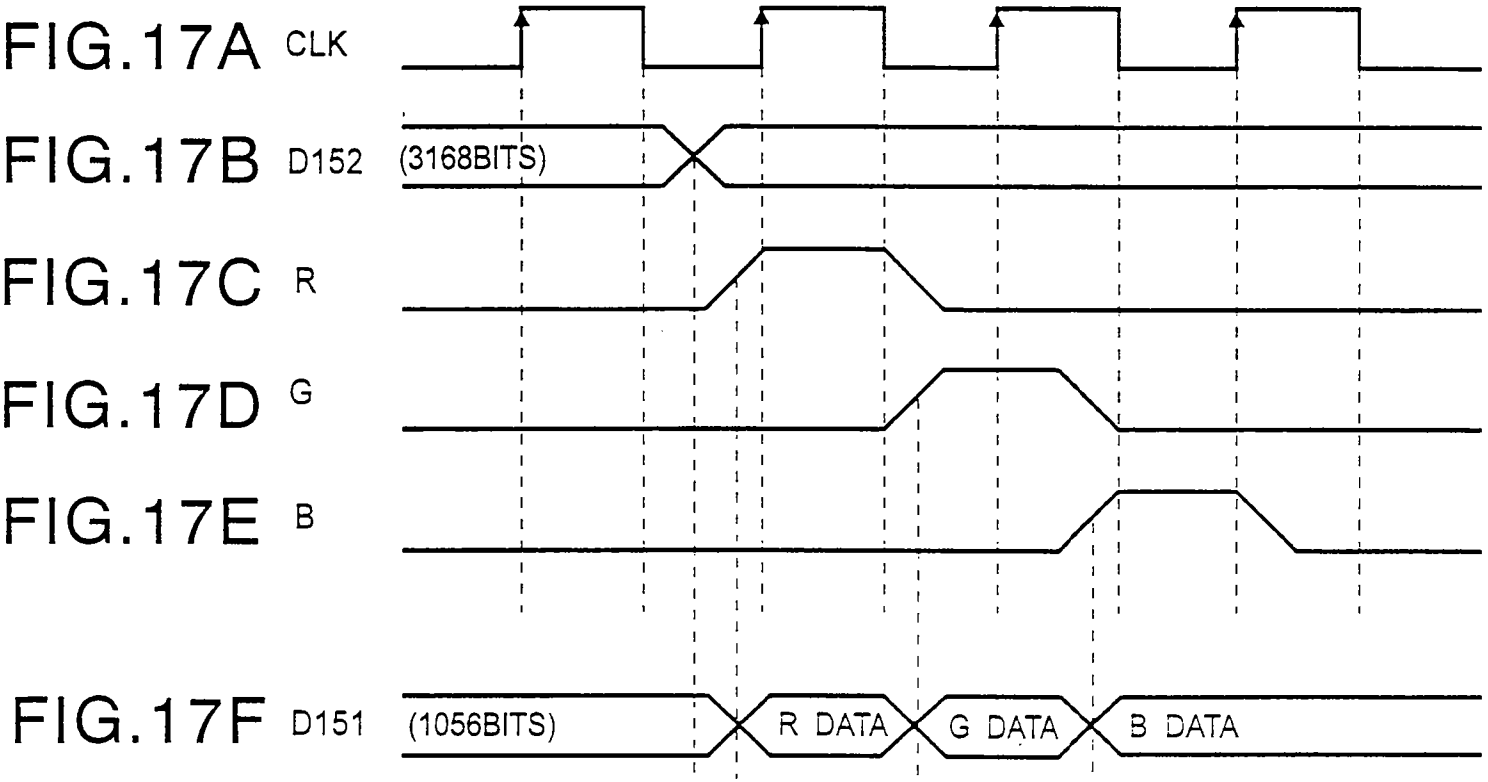
FIGS. 17A to 17F are timing charts of RGB time division of image data in a display according to the eighth embodiment.

FIG. 17A shows a clock signal CLK of the memory; FIG. 17B shows output data D152 (3168 bits) of the line latch 152; FIG. 17C shows red (R) data; FIG. 17D shows green (G) data; FIG. 17E shows blue (B) data; and FIG. 17F shows RGB data D151 (1056 bits) output by the RGB selector circuit 151.

The R, G, B data output from the line latch 152 are converted to the time divided signals asynchronously with the clock by the RGB selector circuit 151 and output from the same terminals of the RGB selector circuit 151. The 3168 bits of data output from the line latch 152 become 1056 bits at the output terminals of the RGB selector circuit 151.

Conventionally, in order to reduce the power consumption of the DACs, it was necessary to adjust the settling time. Since the operating speed is different between the DACs and the memory, they must be separately controlled. When outputting the data of the display memory to the DACs, however, the timing of outputting the RGB data is fixed, so the phase of the data could not be changed freely to match with the characteristics of the DACs.

According to the eighth embodiment, by enabling the asynchronous control of the switching of RGB of the data output to the DACs with respect to the clock of the memory, adjustment matching with the settling time of the DACs can be carried out, so the read system is not disturbed even if an interruption occurs.

Further, the timing can be adjusted matching with the settling time of the DACs, so the power consumption can be reduced. The DACs and memory can be separately controlled, and different operating speeds can be coped with. Further, the phase of the input signal can be easily adjusted.

By providing the RGB selector able to output the data to be output to the DACs by time division by RGB, in comparison with the case where the outputs of the line latch are directly connected to the DACs in one-to-one correspondence, the number of DACs is greatly decreased (two-thirds) and thus the power consumption can be greatly reduced.

Next, an explanation will be given of an example of a preferred configuration of the liquid crystal driver according to the embodiment explained above.

The present liquid crystal driver is for example a one-chip driver IC having a built-in single port or dual port display memory (frame memory), oscillator, timing generator, liquid crystal tone display reference voltage source, and interface circuit with the CPU.

Concretely, it is designed so as to have a built-in dual-port memory of 176 (H)×3×6 (RGB)×240 (V)=760,320 bits and to be compatible for liquid crystal panels having different numbers of pixels such as 120×160 dots, 132×176 dots, 144×176 dots, and 176×240 dots by setting. In the applied liquid crystal panel, for example, the diagonal length is about 2.2 inch, the driver in the horizontal direction includes a TFT selector and the driver IC with the built-in memory of the present invention, the driver in the vertical direction becomes the TFT driver, and the chip is mounted by the COF method or COG method. As the inversion system, an IH/IV (VCOM inversion) system is employed.

The logic system terminals of the present liquid crystal driver IC include CPU interface chip selection, read, write, data bus, address bus, reset, main clock, horizontal synchronization, vertical synchronization, serial data, and other terminals and further includes terminals for liquid crystal panel control.

Assume that by setting a mode register of the present liquid crystal driver, it is possible to change among the asynchronous mode, synchronous mode, color mode, screen mode, alternation mode, refresh rate, standby mode, etc.

Explaining this in detail, in the asynchronous mode, the timing of scanning of the TFT panel and the timing of rewriting the display memory by the CPU may be asynchronous. The display memory is a dual port memory, and the CPU is not allowed to wait.

When the scans of the display memory and the TFT panel are synchronous and the contents of the built-in display memory are output to the DACs in parallel for each of the R, G, B colors for every row by the clock of the internal/external oscillator (self refresh), the data of the blue color is output in the first ⅓ period of one cycle of the clock signal of the shift register of the vertical driver, the data of the green color is output in the middle ⅓ period, and the data of the red color is output in the last ⅓ period.

The CPU interface of the asynchronous mode becomes a parallel interface. When not using a parallel interface, the same function as that of an 8-bit parallel interface is achieved by using a serial interface. Note that a serial interface is used only for writing and cannot perform reading.

In the synchronous mode, the image data are continuously sent in synchronization with the image use clock, the horizontal synchronization signal, and the vertical synchronization signal.

The TFT panel is scanned by using the horizontal and/or vertical synchronization signal, so all timings are synchronous also with the scanning of the TFT panel.

In the synchronous mode, normally, the image data is directly written into the line buffer immediately before the DACs. The display memory holds the information before switching to the synchronous mode.

In the synchronous mode, the image data is transferred without break, therefore a buffer for transferring the data to the DACs and a buffer for sequentially receiving the data exist. The RGB data are input with the width of 18 bits to line buffers alternating by the cycle of the horizontal synchronization signal (Hsync). When output, the R data is first sent to the DACs with the width of 6 bits in the first ⅓ period of the horizontal synchronization signal Hsync, next the G data is sent to the DACs with the width of 6 bits in the middle ⅓ period of the horizontal synchronization signal Hsync, then the B data is sent to the DACs with the width of 6 bits in the last ⅓ period of the horizontal synchronization signal Hsync.

In the synchronous mode, there also exists the so-called "capture" system of handling image data where image data is fetched once into the display memory.

The RGFB parallel bus interface of the synchronous mode will be explained next. The image data is latched at the rising edge of the image signal clock synchronized with the image signal by default, but this can be changed from the CPU.

The polarity of the horizontal synchronization signal is negative (can be changed from CPU) by default. One cycle is formed by a vertical blanking period+video signal period.

The image signal is latched by the image clock.

For the CPU interface of the synchronous mode, only a serial interface can be used in the synchronous mode. The serial interface is used only for writing and cannot perform reading. In the serial interface, the operation is similar to that of a parallel 8-bit bus mode.

By setting the mode register of the liquid crystal driver, various color modes can be set.

In the full color mode, the built-in 6-bit DACs are used to convert 6 bits of RGB to 64 stages of voltage for output.

In the reduced color mode (8-color mode), the ground or output amplifier use high voltage power supply level VCC is output according to the page indicated by a special effect register, that is, for the most significant bit (MSB) among 6 bits of the RGB when the page is 1, for the second bit from the most significant bit when the page is 2, or for the least significant bit (LSB) when the page is 6. At this time, the supply of the power to the built-in 6-bit DACs is stopped.

The screen mode will be explained next.

In the full screen mode, the entire screen is displayed by the color mode designated by the status register.

In the partial screen mode, only the portion designated by the status register is displayed by the color mode designated by the status register. When a portion other than this is scanned, white is displayed by the designated color mode.

Next, the standby mode will be explained.

In a transition period of the standby mode, the value of the standby mode of the mode register is referred to for each one phase for every field cycle. When the awake mode is entered again during a transition from the awake mode to the asleep mode according to this value, feedback is given while maintaining the sequence.

After turning on the power or after a hardware reset, the liquid crystal driver IC enters the asleep mode.

In the awake mode, from the asleep state, the sequence of:

Start Oscillation of Built-in Oscillator

6 Activate DC/DC converter

6 Reset panel

6 Rapidly charge coupling capacitor of common voltage

6 Display white on entire screen is executed, then the awake (normal) mode is entered.

In the asleep mode, from the awake state, the sequence of:

Display White on Entire Screen

6 Rapidly discharge coupling capacitor of common voltage

6 Reset panel

6 Stop DC/DC converter

6 Start oscillation of built-in oscillator is executed, then the asleep mode is entered.

The display memory access mode will be explained next.

According to the contents of the display memory access mode register, eight types of sequential memory accesses are possible such as portrait, landscape, normal, mirror, normal, and upset.

Special functions of the liquid crystal driver will be explained next.

In the image fetching function, the content of the frame memory for a moving picture signal is held for the period where the capture flag of the frame memory access register is "0".

When the capture flag becomes "1", one frame after the next vertical synchronization signal is fetched into the frame memory.

When the capture flag changes from "1" to "0", after the next vertical synchronization signal, the content of the frame memory is held.

In the common voltage initial charging function, the DC cut capacitor of the output terminal of the common voltage can be rapidly charged and discharged.

Facing the DC cut capacitor of the output terminal of the common voltage, a DC offset terminal is connected and sag occurs.

In order to keep the sag small in the display mode as well, the DC offset terminal is made a high resistance and a long time is taken for the charging and discharging of the DC offset to and from the capacitor.

At the time of turning on/off the power supply, however, if the DC offset is not rapidly charged or discharged, the display quality is lowered in the period of transition from the initial state to normal state.

Particularly, at the time of discharge, an after image is displayed if the DC offset still remains even after the power is cut. For this reason, rapid charging and discharging become necessary.

In the reset function, the hardware is reset by a reset signal from a reset pin connected to the CPU. The register/frame memory is not reset.

The software is reset by a command from the CPU. The contents of the display memory/some registers are held.

In the contrast control function, since a display using much black consumes a large power, the contrast is lowered and black display is avoided (definition of contrast is luminance of white/luminance of black, so lowering of contrast in this case means raising luminance of black while keeping luminance of white as it is).

In the case of 6-bit RGB data, 00H 6 charge and discharge panel by 6V amplitude 6 display black 6 large power consumption. 20H 6 charge and discharge panel by 3V amplitude 6 display gray. 3FH 6 charge panel by 0.4V amplitude 6 display white.

Therefore, divide 6 bits by 2 (discard least significant 1 bit) and add 20H, 00H 6 20H 6 charge and discharge panel by 3V amplitude 6 display black, 20H 6 30H 6 charge and discharge panel by 1.5V amplitude 6 display gray, 3FH 6 3FH 6 charge and discharge panel by 0.4V amplitude 6 display white. A reduction of contrast is realized by making 32,000 colors.

In the scroll function, the panel end memory pointer is controlled so as to change the data to be transferred from the frame memory to the panel so that it appears to roll on the display. It is possible to control the roll starting row, roll row width, and roll speed/direction by a dedicated register.

In the negative-positive inversion function, when two points on the screen are designated by the dedicated register, the inside of a rectangle having the two points as diagonals inverts between negative and positive.

The panel end memory pointer is monitored, and the output of the display memory is inverted then sent to the DACs in the period where the pointer is in a designated range.

In the blinking function, when two points on the screen are designated by the dedicated register, the inside of a rectangle having the two points as diagonals blinks.

The panel end memory pointer is monitored, and a logical AND of the output of the display memory and the output of a blinking cycle counter is sent to the DAsC in the period where the pointer is in a designated range.

In the built-in DC/DC converter control function, the CPU can control the switch for setting usage/sealing of the built-in DC/DC converter and the ON/OFF switches of the channels of the DC/DC converter.

In the built-in LED driver control function, the CPU can set the switch for setting usage/sealing of the built-in LED driver and the current sink capability adjustment (8 stages) of the LED driver.

The liquid crystal driver is provided with a large number of registers and pointers to realize the above specifications.

The present invention is not limited to the embodiments explained above. Various modifications are possible in a range not out of the gist of the present invention.

In the first embodiment, the first access for outputting data from the display memory to the pixels was carried out in the low level period of the clock signal of the display memory, while the second access for an external controlling means to read data from the display memory and write data into the display memory was carried out in the high level period of the clock signal of the display memory, but it is also possible to perform the first access in the high level period of the clock signal and perform the second access in the low level period of the clock signal.

Further, in the second embodiment, one power supply switch transistor is provided for every memory cell, but it is also possible to control the power supplies of memory cells of predetermined regions of the memory all together in accordance with actual conditions.

As explained above, according to the present invention, by imparting two systems of read ports and one system of write ports to the two sides of the display memory, the cell size can be greatly reduced in comparison with the case of using an ordinary dual port memory, the interconnect resources can be reduced, and the power for the amount of the interconnects can be reduced.

Further, by assigning the display use access and the CPU use access to the memory to the high level period and low level period of the clock signal of the memory, the waiting time of the CPU for display can be reduced.

By dividing the power supply to supply the drive power supply voltage to the memory and by cutting the supply of power to regions of the memory cells which are not used, the power consumption can be reduced.

Further, by the system of writing for every bit or for every pixel not requiring a read-modify-write sequence, the number of times of operation of the memory can be reduced. Since data can be written into the memory for any single pixel by a single access, the read-modify-write sequence becomes unnecessary. Rewriting in units of pixels also consumes less power in comparison with the conventional case.

By enabling simple mapping of the driver circuit and memory array, calculation for linking addresses and pixels of the display screen becomes unnecessary. Further, dealing with driver circuits for a variety of numbers of pixels becomes easy. It is possible to link the screen, memory mapping, and line latch and write data to the memory for any single pixel, possible to write data for any plurality of pixels on the same line by one access to the memory, and possible to designate X, Y-coordinates on the display screen as the address from the CPU side.

By imparting a line latch between the processor and the display memory and operating it by one read operation per row display, the number of times of operation of the memory is reduced. By this, the power consumption of the memory can be reduced.

In a display memory built into a driver circuit, by providing a line latch having a capacity required for holding one line's worth of data in the horizontal direction on the LCD panel screen between the display memory and the DACs and providing a bit width the same as one line's worth of the bit width in the line latch, it becomes possible to read and write one line's worth of the data in any horizontal direction on the screen at one time. By reducing the number of times of access to the memory, the power consumption can be reduced.

By reading and writing one line's worth of data held in the memory at one time in synchronization with the clock of the memory, the period after holding one line's worth of the data can be used for the access time of the CPU, therefore it is possible to deal with even display of a moving picture requiring quick switching of the screen.

By the RGB selector selection circuit able to output data to be output to the DACs by time division by RGB, in comparison with the case where the outputs of the line latch are directly connected to the DACs by one-to-one correspondence, the number of DACs can be decreased to one-third and the power consumption can be reduced.

By enabling the control of the switching of RGB of the data to be output to the DACs asynchronously with respect to the clock of the memory, the DACs and the memory can be separately controlled and different operating speeds can be coped with. Further, even if the interruption occurs, the read system is not disturbed and the phase of the input signal can be easily adjusted. By adjusting the timing matched with the settling time of the DACs, the power consumption can be reduced.

INDUSTRIAL APPLICABILITY

According to the display memory, driver circuit, and display of the present invention, the power consumption can be reduced, graphics can be generated at a high speed, and there is no need for memory mapping, therefore they can be applied to the display system of a mobile phone, PDA, or other portable information device (portable information apparatus).

The invention claimed is:

1. A driver circuit which drives a plurality of pixels arrayed in a matrix in a display, comprising:

a first line latch which stores pixel data corresponding to a horizontal line of pixels from the matrix of pixels in the display in a display memory;

a driving unit which writes the pixel data supplied from said first line latch into said display memory via a controller unit; and a second line latch which buffers the pixel cell data corresponding to the horizontal line of pixels stored in the display memory for output to the display, wherein, the driving unit is configured to read the pixel data from said display memory, and to output the pixel data to said controller unit via the first line latch, said first line latch designates which pixel data in the first line latch is written into the display memory, said driving unit writes only the pixel data held in said first line latch designated for writing into the display memory, and said display memory includes:

(1) a plurality of memory cells arrayed in a matrix corresponding to the matrix array of said plurality of pixels, each memory cell having a first storage node and a second storage node configured to hold states of a complementary first level and second level, (2) a first read port which reads the stored data of said first storage node of each memory cell, (3) a second read port which reads the stored data of said second storage node of each memory cell, and (4) a write port which writes pixel data for driving corresponding pixel cells of the matrix of said display into said memory cells.

2. A driver circuit as set forth in claim 1, wherein said driving unit is configured to store an amount of data equal to the amount of pixel data in the horizontal line of pixels in said first line latch and to then write the same into said display memory at one time.

3. A driver circuit as set forth in claim 1, wherein said driving unit outputs the pixel data from the horizontal line of pixels of the plurality of pixels in the matrix at one time from said display memory to said first line latch.

4. A driver circuit as set forth in claim 1, wherein said driving unit stores a pixel data from each pixel in the horizontal line of pixels in said display memory which drives a corresponding pixel in a corresponding horizontal line of pixels in the display.

5. A driver circuit which drives a plurality of pixels arrayed in a matrix in a display comprising:

a first line latch which stores pixel data corresponding to a horizontal line of pixels of the plurality of pixels in the matrix in a display memory; and an outputting unit which reads said pixel data stored in said display memory via a second line latch and which outputs the same to the corresponding pixels of said display, wherein said second line latch designates which pixel data in the second line latch is written into the display; and said outputting unit outputs only the pixel data held in said second line latch designated for outputting to the display, and said display memory includes:

(1) a plurality of memory cells arrayed in a matrix corresponding to the matrix array of said plurality of pixels, each memory cell having a first storage node and a second storage node configured to hold states of a complementary first level and second level, (2) a first read port which reads the stored data of said first storage node of each memory cell, (3) a second read port which reads the stored data of said second storage node of each memory cell, and (4) a write port which writes pixel data for driving corresponding pixel cells of the matrix of said display into said memory cells.

6. A driver circuit as set forth in claim 5, wherein a respective bit width of said first and second line latch is the same as a bit width of the pixel data from the horizontal line of pixels of the matrix.

7. A driver circuit as set forth in claim 5, wherein said outputting unit performs a first access which outputs the image data stored in said display memory to said pixels in a first level period of a clock signal of said display memory, and a controlling unit performs a second access which reads the image data stored in said display memory and writes the data to be written into said display memory in a second level period of the clock signal of said display memory.

8. A driver circuit as set forth in claim 5, wherein said circuit further comprises:

a selection circuit which sequentially selects a R, G, B data included in the pixel data held in said second line latch and converts said pixel data to time divided signals and digital/analog converting unit which converts digital signals to analog signals, said selection circuit outputs the time divided signals obtained by time division of the R, G, B data included in said pixel data to said digital/analog converting unit, and said digital/analog converting unit converts the time divided signals to the analog signals and supplies the same to said display.

9. A driver circuit as set forth in claim 8, wherein said selection circuit selects the R, G, B data included in the pixel data held in said second line latch asynchronously with the clock signal of said display memory and converts them to time divided signals.

10. A display comprising:

a display screen including a plurality of pixels arrayed in a matrix;

a scanning circuit which scans said matrix by each row and supplies a voltage to a selected row;

a driver circuit which outputs signals corresponding to pixel data to said pixels;

a display memory which stores said pixel data; and a first line latch which buffers the pixel data corresponding to a horizontal line of pixels stored in the display memory for output to the display screen, wherein, said driver circuit includes (1) a second line latch which stores pixel data from a horizontal line of said plurality of pixels in the matrix and (2) a driving unit which writes the data supplied from a controlling unit into said display memory and reads the pixel data from said display memory via said second line latch and outputs the same to said controlling unit, said second line latch designates which pixel data in the second line latch is written into the display memory, said driving unit writes only the pixel data held in said second line latch designated for writing into the display memory, and said display memory includes:

(1) a plurality of memory cells arrayed in a matrix corresponding to the matrix array of said plurality of pixels, each memory cell having a first storage node and a second storage node configured to hold states of a complementary first level and second level, (2) a first read port which reads the stored data of said first storage node of each memory cell, (3) a second read port which reads the stored data of said second storage node of each memory cell, and (4) a write port which writes pixel data for driving corresponding pixel cells of the matrix of said display screen into said memory cells.

11. A display as set forth in claim 10, wherein said driving unit stores the pixel data in said second line latch up to the amount of one line, then writes the same into said display memory at one time.

12. A display as set forth in claim 10, wherein said driving unit outputs the pixel data from the horizontal line of pixels in the matrix at one time from said display memory to said second line latch.

13. A display as set forth in claim 10, wherein said driving unit stores each pixel data from the horizontal line of pixels in the matrix held in said second line latch in said display memory as pixel data which drives a corresponding pixel of a corresponding line among said pixels arrayed in the display.

14. A display comprising:

a display screen including a plurality of pixels arrayed in a matrix;

a scanning circuit which scans said matrix by each row and supplies a voltage to a selected row;

a driver circuit which outputs signals corresponding to pixel data supplied from a controlling unit to said pixels; and a display memory which stores said image data, wherein, said driver circuit includes (1) a first line latch which stores pixel data from a row of pixels of said matrix and (2) an outputting unit which reads said image data from the row of pixels from said display memory via a second line latch and supplies the same to corresponding pixels of said display screen, said second line latch designates which pixel data in the second line latch is written to the display screen, said outputting unit outputs only the pixel data held in said second line latch designated for outputting to the display screen, and said display memory includes:

(1) a plurality of memory cells arrayed in a matrix corresponding to the matrix array of said plurality of pixels, each memory cell having a first storage node and a second storage node configured to hold states of a complementary first level and second level, (2) a first read port which reads the stored data of said first storage node of each memory cell, (3) a second read port which reads the stored data of said second storage node of each memory cell, and (4) a write port which writes pixel data for driving corresponding pixel cells of the matrix of said display screen into said memory cells.

15. A display as set forth in claim 14, wherein a respective bit width of said first and second line latch is the same as a bit width of the pixel data from the horizontal line of pixels in the matrix.

16. A display as set forth in claim 14, wherein:

said outputting unit performs a first access which outputs the image data stored in said display memory to said pixels in a first level period of a clock signal of said display memory, and said controlling unit performs a second access which reads the image data stored in said display memory and writes the designated data into said display memory in a second level period of the clock signal of said display memory.

17. A display as set forth in claim 14, wherein said driver circuit further comprises:

a selection circuit which sequentially selects a R, G, B data included in the pixel data held in said second line latch and converts said pixel data to time divided signals and digital/analog converting unit which converts digital signals to analog signals;

said selection circuit outputs the time divided signals obtained by time division of the R, G, B data included in said pixel data to said digital/analog converting unit; and said digital/analog converting unit converts the time divided signals to the analog signals and supplies the same to said display screen.

18. A display as set forth in claim 17, wherein said selection circuit selects the R, G, B data included in the pixel data held in said second line latch asynchronously to the clock signal of said display memory and converts them to time divided signals.

19. A portable information comprising:

a display including a plurality of pixel cells arrayed in a matrix; and a display memory which stores pixel data which is supplied to pixel cells of said display, wherein, (a) said display memory includes (1) a controlling unit which controls the operation of said display memory, (2) a plurality of memory cells, each having a first storage node and a second storage node configured to hold states of a complementary first level and second level, arrayed in a matrix corresponding to the matrix array of said plurality of pixel cells, (3) a first read port which reads the stored data of said first storage node of each memory cell, (4) a second read port which reads the stored data of said second storage node of each memory cell, (5) a write port which writes pixel data for driving corresponding pixel cells of the matrix of said display into said memory cells, (6) a first line latch which stores the pixel data from a horizontal line arrayed in the matrix of pixels, and (7) a second line latch which stores the pixel data from the horizontal line arrayed in the matrix of pixels, (b) said write port outputs said pixel data from the horizontal line arrayed in the matrix of pixels to a plurality of said memory cells via said first line latch, (c) said first read port latches the pixel data in said second line latch in units of lines and outputs the same to corresponding pixel cells of said display, and (d) said second read port outputs said one line's worth of data to said controlling unit via said first line latch.

* * * * *